US009063451B2

(12) United States Patent
Hara et al.

(10) Patent No.: US 9,063,451 B2
(45) Date of Patent: Jun. 23, 2015

(54) IMAGE FORMING APPARATUS

(71) Applicant: CANON KABUSHIKI KAISHA, Tokyo (JP)

(72) Inventors: Seiji Hara, Tokyo (JP); Ichiro Okumura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/184,008

(22) Filed: Feb. 19, 2014

(65) Prior Publication Data

US 2014/0233989 A1 Aug. 21, 2014

(30) Foreign Application Priority Data

Feb. 19, 2013 (JP) ..... 2013-029573

(51) Int. Cl.
*G03G 15/00* (2006.01)
*G03G 15/01* (2006.01)

(52) U.S. Cl.
CPC ..... *G03G 15/0189* (2013.01); *G03G 15/5054* (2013.01); *G03G 2215/00054* (2013.01); *G03G 2215/0158* (2013.01)

(58) Field of Classification Search
CPC ..... G03G 15/18; G03G 15/5058
USPC ..... 399/154, 301
See application file for complete search history.

(56) References Cited

U.S. PATENT DOCUMENTS

| | | | | |
|---|---|---|---|---|
| 6,393,244 | B1 * | 5/2002 | Nakayasu et al. | 399/301 |
| 8,676,100 | B2 | 3/2014 | Shimizu et al. | |
| 2010/0209124 | A1 * | 8/2010 | Mizutani et al. | 399/16 |
| 2012/0121283 | A1 * | 5/2012 | Mori et al. | 399/66 |

FOREIGN PATENT DOCUMENTS

| | | | |
|---|---|---|---|
| JP | 2001-134036 | A | 5/2001 |
| JP | 2007-003986 | A | 1/2007 |
| JP | 2012-042875 | A | 3/2012 |

* cited by examiner

*Primary Examiner* — Gregory H Curran
(74) *Attorney, Agent, or Firm* — Fitzpatrick, Cella, Harper & Scinto

(57) ABSTRACT

Electrostatic image graduations inclined by a first angle in a main scanning direction are formed on a photosensitive drum and transferred to an intermediate transfer belt, and electrostatic image graduations inclined by a second angle in the main scanning direction are formed on the photosensitive drum and transferred to the intermediate transfer belt so as to overlap with the electrostatic image graduations inclined by the first angle. The electrostatic image graduations inclined by the first angle are detected by a conducting wire having a linear conductive member inclined by the first angle in the main scanning direction of the intermediate transfer belt. The electrostatic image graduations inclined by the second angle are detected by a conducting wire having a linear conductive member inclined by the second angle in the main scanning direction of the intermediate transfer belt.

17 Claims, 27 Drawing Sheets

FIG.5A PLAN VIEW
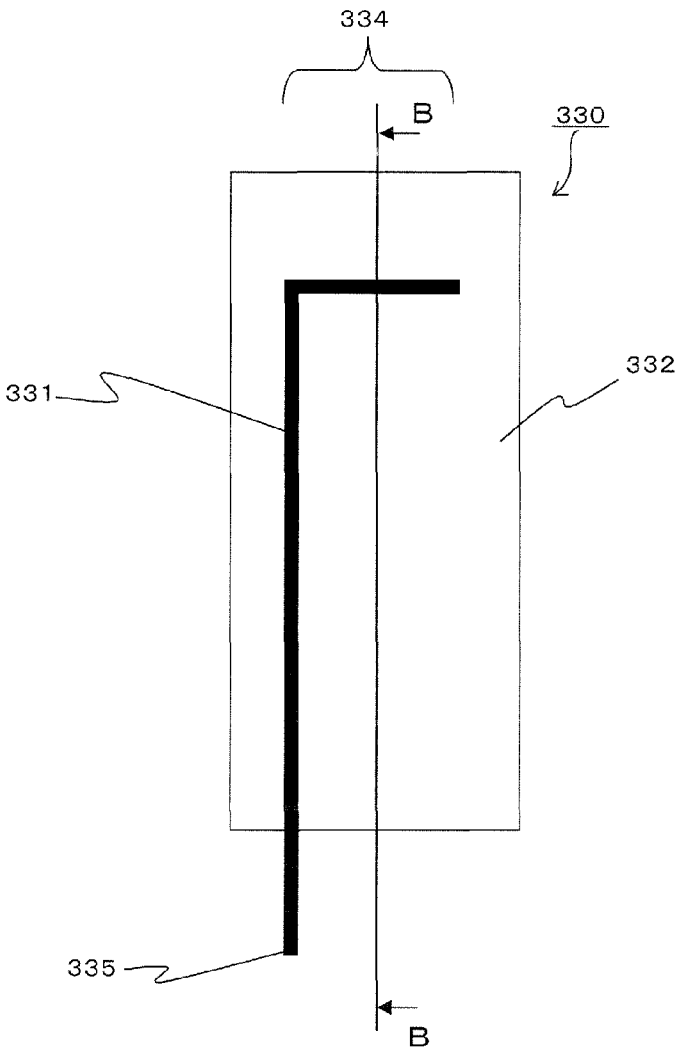
FIG.5B CROSS SECTIONAL VIEW TAKEN ALONG LINE B-B
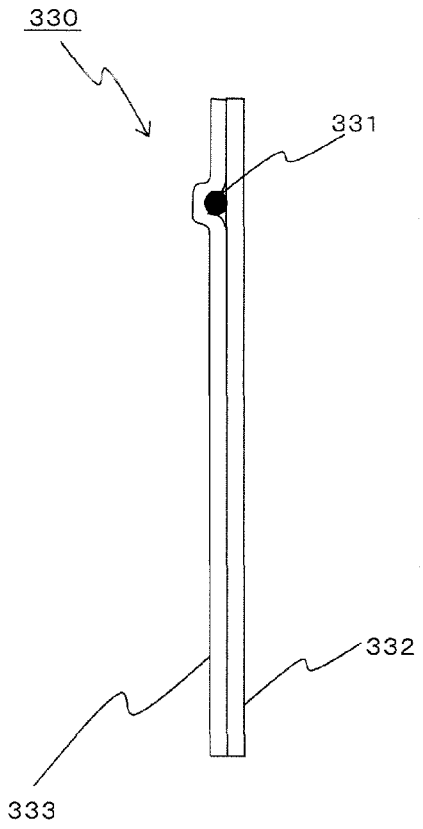

FIG.6A PLAN VIEW
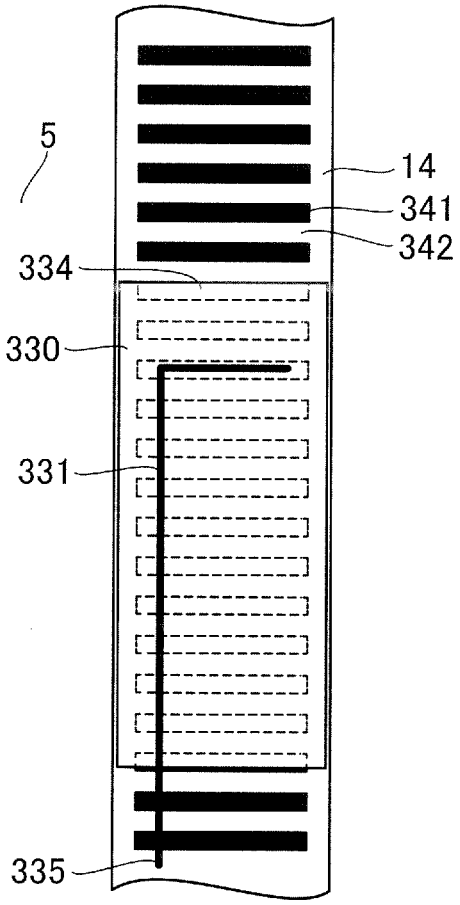
FIG.6B SIDE VIEW
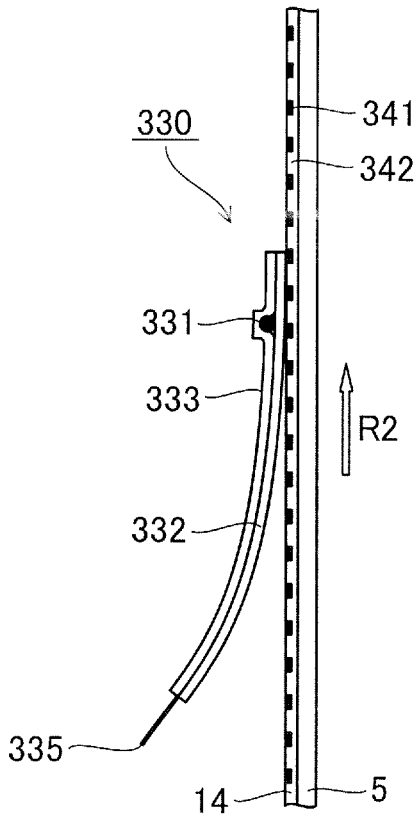

5
14

342
341
POTENTIAL DISTRIBUTION

OUTPUT VOLTAGE
t 0.3387mm
PITCH
5
14

342
341
POTENTIAL DISTRIBUTION

OUTPUT VOLTAGE
t

FIG.11A ELECTROSTATIC IMAGE GRADUATIONS
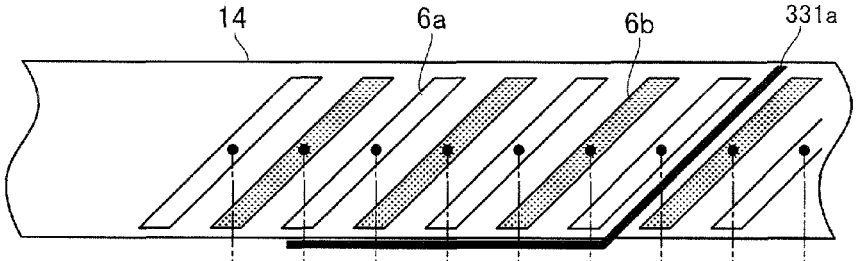
FIG.11B OUTPUT
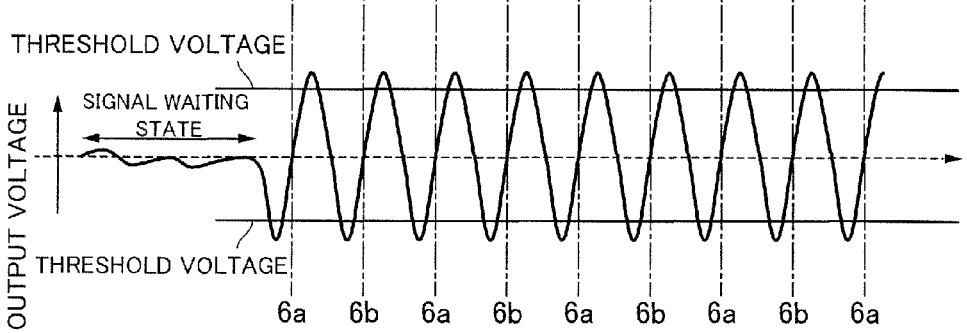

FIG.12A ELECTROSTATIC IMAGE GRADUATIONS
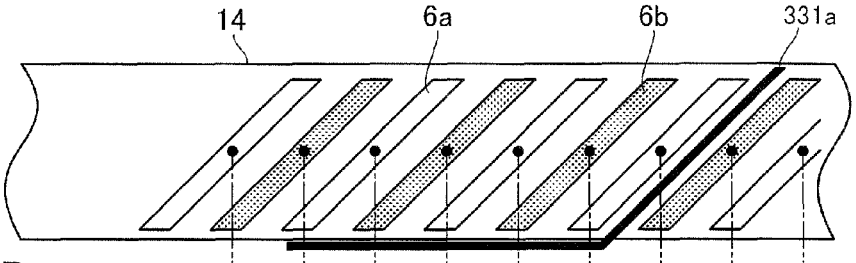
FIG.12B OUTPUT
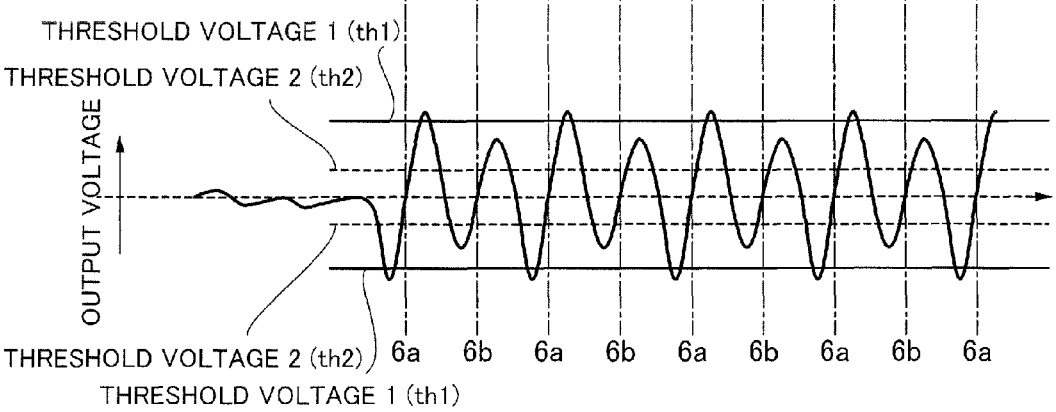

FIG.16A ELECTROSTATIC IMAGE GRADUATIONS
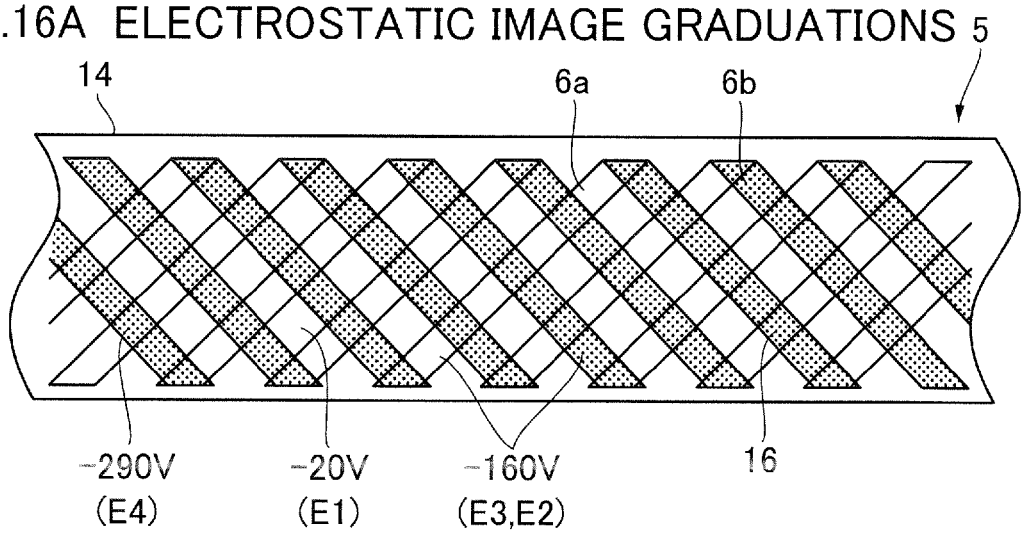
FIG.16B BELT GRADUATION DETECTION SENSOR
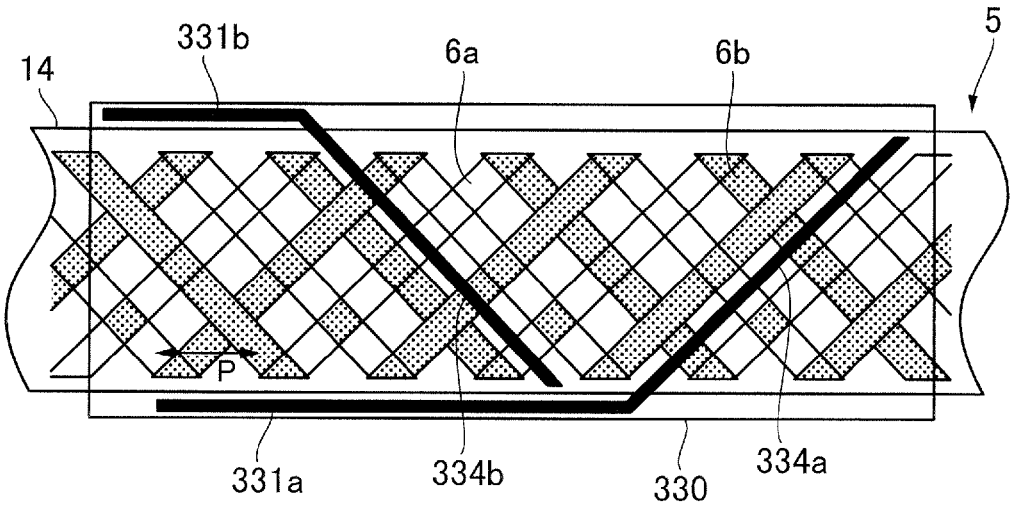

IMAGE FORMING APPARATUS

BACKGROUND OF THE INVENTION

1. Field of the Invention

This disclosure relates to an image forming apparatus configured to superimpose toner images formed on a plurality of photosensitive members one on top of another by using a conveying member.

2. Description of the Related Art

An image forming apparatus configured to superimpose a plurality of toner images formed respectively on a plurality of photosensitive members by using a conveying member (an intermediate transfer member or a recording material conveying member) one on top of another is widely used. When exposure of an image from one scanning line to another is performed on a plurality of the photosensitive members, positional shift occurs in a main scanning direction and a sub scanning direction between a plurality of the toner images conveyed in a superimposed manner on the conveying member. Therefore, the image forming apparatus provided with a plurality of the photosensitive members performs a detection mode in which alignment toner images are formed on a plurality of the photosensitive members and are transferred to conveying members, and a plurality of the alignment toner images are detected on the conveying member by using an optical sensor, when an image is not formed.

For example, in JP-A-2001-134036, linear alignment toner images inclined from the main scanning direction of the photosensitive members by a predetermined angle are formed on a plurality of the photosensitive members and transferred to the conveying member. Depending on the result of detection of the alignment toner images transferred from a plurality of the photosensitive members to the conveying member, positions of the toner image to be formed on the respective photosensitive members in the main scanning direction and the sub scanning direction are adjusted.

In JP-A-2007-3986, linear alignment toner images inclined by different angles with respect to the sub scanning direction are formed on a plurality of the photosensitive members, are transferred to the conveying member, and are superimposed one on top of another. Depending on the result of detection of the alignment toner images superimposed on the conveying member, positions of the toner image to be formed on the respective photosensitive members in the main scanning direction and the sub scanning direction are adjusted.

In JP-A-2012-42875, an electrostatic image graduation including electrostatic image indexes arranged in parallel in the main scanning direction at regular intervals in the sub scanning direction is formed on a photosensitive member on an upstream-most side and is transferred to a conveying member. On a plurality of photosensitive members on a downstream side, the electrostatic image indexes formed on the photosensitive members and the electrostatic image indexes formed on the conveying member are aligned to adjust superimposition of the toner images in real time.

As described in JP-A-2007-3986, when the linear toner images are superimposed on the conveying member, positional information (or timing information) cannot be acquired individually from the respective linear toner images. Therefore, as described in JP-A-2001-134036, toner image scales, the positional information of which are acquired individually, need to be formed with appropriate shift in the main scanning direction so as not to be superimposed with each other. Therefore, a plurality of tracks for forming the toner image scale need to be formed on the conveying member in parallel, and hence a reduction in size of the photosensitive members or the conveying member is hindered.

SUMMARY OF THE INVENTION

This disclosure provides an image forming apparatus including a first photosensitive member configured to be formed a toner image on a surface thereof, a first exposure device configured to from an electrostatic image which becomes the toner image by being developed on the first photosensitive member and to form a first electrostatic image index formed by a linear electrostatic image that is inclined by a first angle in a main scanning direction orthogonal to a sub scanning direction, which corresponds to the direction of rotation of the first photosensitive member, on the first photosensitive member, a conveying member, a first transfer portion configured to transfer the first electrostatic image index formed on the first photosensitive member to the conveying member together with the toner image, a second photosensitive member disposed on a downstream of the first photosensitive member in the direction of movement of the conveying member, a second exposure device configured to form a linear second electrostatic image index that is inclined by a second angle different from the first angle in the main scanning direction of the second photosensitive member on the second photosensitive member, a second transfer portion configured to transfer the second electrostatic image index formed on the second photosensitive member so as to overlap with the first electrostatic image index that is transferred to the conveying member, a first detecting portion having a linear conductive member inclined by the first angle in the main scanning direction with respect to the conveying member and configured to detect an induced current generated in the linear conductive member inclined by the first angle by passage of the first electrostatic image index transferred to the conveying member, and a second detecting portion having a linear conductive member inclined by the second angle in the main scanning direction with respect to the conveying member and configured to detect an induced current generated in the linear conductive member inclined by the second angle by passage of the second electrostatic image index transferred to the conveying member.

Further features of the present invention will become apparent from the following description of exemplary embodiments with reference to the attached drawings. The accompanying drawings, which are incorporated in and constitute apart of the specification, illustrate exemplary embodiments, features, and aspects of the invention and, together with the description, serve to explain the principles of the invention.

BRIEF DESCRIPTION OF THE DRAWINGS

FIG. 5A is a plan view illustrating a configuration of an induced current sensor.

FIG. 5B is a cross-sectional view taken along a line B-B in the induced current sensor illustrated in FIG. 5A.

FIG. 6A is a plan view illustrating a state when the electrostatic image graduation is detected.

FIG. 6B is a side view of FIG. 6A.

FIG. 11A is a schematic drawing illustrating an electrostatic image graduation of Comparative Example 1.

FIG. 11B is a graph illustrating an output signal when the electrostatic image graduation illustrated in FIG. 11A is detected by an induced current sensor.

FIG. 12A is a schematic drawing illustrating an electrostatic image graduation of Comparative Example 2.

FIG. 12B is a graph illustrating an output signal when the electrostatic image graduation illustrated in FIG. 12A is detected by an induced current sensor.

FIG. 16A is an explanatory drawing of a potential state of respective portions of intersecting electrostatic image graduation.

FIG. 16B is a schematic drawing illustrating a state in which the electrostatic image graduation illustrated in FIG. 16A is detected by the induced current sensor.

DESCRIPTION OF THE EMBODIMENTS

Figure 1:
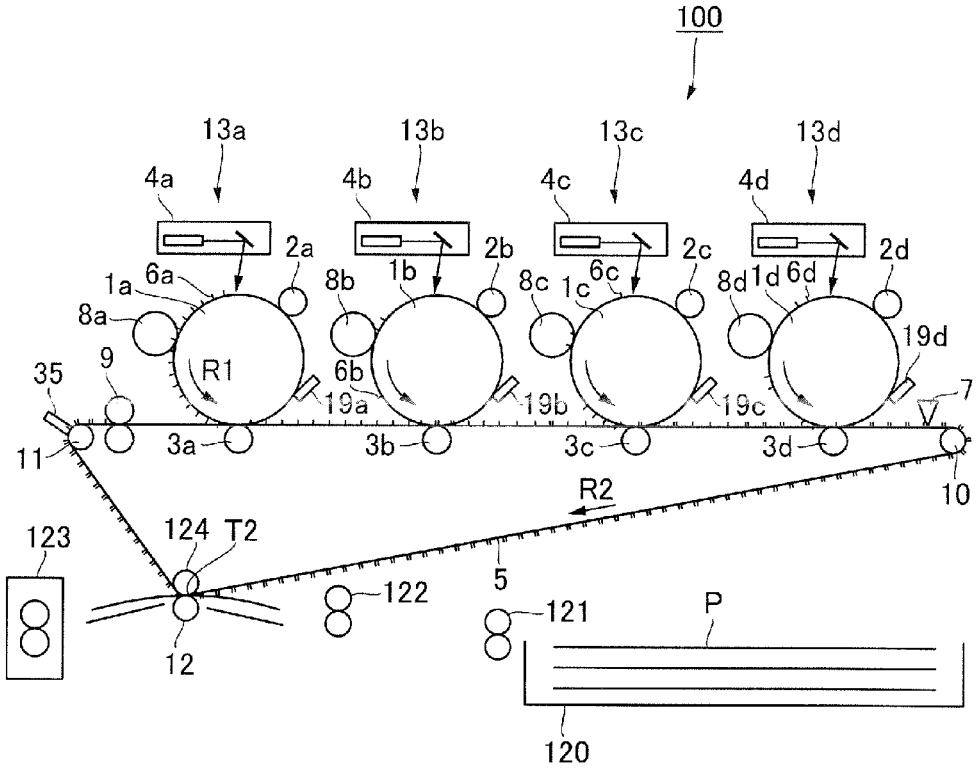
FIG. 1 is an explanatory drawing illustrating a configuration of an image forming apparatus.

Referring now to the drawings, embodiments of this disclosure will be described in detail.

First Embodiment

<Image Forming Apparatus>

FIG. 1 is an explanatory drawing illustrating a configuration of an image forming apparatus. As illustrated in FIG. 1, an image forming apparatus 100 is a tandem-type intermediate transfer system full-color printer in which image forming units 13*a*, 13*b*, 13*c*, and 13*d* for yellow, magenta, cyan, and black are arranged along an intermediate transfer belt 5.

In the image forming unit 13*a*, a yellow toner image is formed on a photosensitive drum 1*a* and is transferred to the intermediate transfer belt 5. In the image forming unit 13*b*, a magenta toner image is formed on a photosensitive drum 1*b* and is transferred to the intermediate transfer belt 5. In the image forming units 13*c* and 13*d*, a cyan toner image and a black toner image are formed respectively on photosensitive drums 1*c* and 1*d* and are transferred to the intermediate transfer belt 5.

A recording material P drawn out from a recording material cassette 120 is separated by a separation roller 121 into pieces, and is fed to registration rollers 122. The registration rollers 122 are configured to feed the recording material P to a secondary transfer portion T2 at an adequate timing with the toner image on the intermediate transfer belt 5. A secondary transfer roller 12 is applied with a voltage in the course in which the recording material P is conveyed in the secondary transfer portion T2, and the toner image on the intermediate transfer belt 5 is secondarily transferred to the recording material P. The recording material P to which the toner image is secondarily transferred is conveyed to a fixing device 123, is heated and pressurized by the fixing device 123, and is discharged out of the machine after the toner image is fixed.

The intermediate transfer belt 5 is extended around a tension roller 11, a belt drive roller 10, and an opposed roller 124, and is applied with a predetermined tension by the tension roller 11. The belt drive roller 10 is driven to rotate by a drive motor, which is not illustrated, rotates the intermediate transfer belt 5 at a predetermined process speed in a direction indicated by an arrow R2. A belt cleaning apparatus 35 causes a cleaning blade to slide along the intermediate transfer belt 5 to collect residual toner from the intermediate transfer belt 5 that has passed through the secondary transfer portion T2.

<Image Forming Unit>

The image forming units 13*a*, 13*b*, 13*c*, and 13*d* have the same configuration except that the colors of toners used in developing devices 8*a*, 8*b*, 8*c*, and 8*d* are different from each other. Therefore, in the following description, only the image forming unit 13*a* will be described, and hence description of the other image forming units 13*b*, 13*c*, and 13*d* are considered to have been given by replacing an alphabet added to the end of reference sign indicating components of the image forming unit 13*a* with b, c, and d.

The image forming unit 13*a* includes a charging roller 2*a*, an exposure device 4*a*, the developing device 8*a*, a primary transfer roller 3*a*, and a drum cleaning unit 19*a* arranged around the photosensitive drum 1*a*. The photosensitive drum 1*a* includes a photosensitive layer formed of an OPC photosensitive material having a thickness of 30 μm and charged in negative polarity on an outer peripheral surface of an aluminum cylinder. The photosensitive drum 1*a* rotates in a direction indicated by an arrow R1 at a process speed of 300 mm/sec upon transmission of a drive force from a drum drive motor, which is not illustrated. A rotary encoder, which is not illustrated, is coupled to the photosensitive drum 1*a*. The photosensitive drum 1*a* rotates at a regular angular speed by the drum drive motor being controlled to cause the rotary encoder to output constant-frequency pulses.

The charging roller 2*a* is applied with a vibration voltage which is a DC voltage on the order of −600 V on which an AC voltage is superimposed to charge a surface of the photosensitive drum 1*a* at a dark portion potential VD at a constant −600V.

The exposure device 4*a* is configured to perform scanning exposure with a laser beam by using a rotary mirror, and lowers the dark portion potential VD of the photosensitive drum 1*a* to a bright portion potential VL to write an electrostatic image of an image. The exposure device 4*a* forms the electrostatic image by changing a surface potential of a laser light irradiating portion on the surface of the photosensitive drum 1*a* into a potential on the order of −100 V in accordance with an image signal.

The developing device 8*a* develops the electrostatic image by using a two-component developer including toner and carrier and forms a toner image of the image on the surface of the photosensitive drum 1*a*. Yellow toner is adhered to an area of the bright portion potential VL which is exposed by the exposure device 4*a* and hence has the surface potential changed to the potential on the order of −100 V, so that an inverted yellow toner image is developed.

The primary transfer roller 3*a* has a diameter on the order of 16 mm, is formed of sponge having a conductive surface, and is configured to press an inner side of the intermediate transfer belt 5 to form a primary transfer portion between the photosensitive drum 1*a* and the intermediate transfer belt 5. A DC voltage on the order of +1000 V is applied to the primary transfer roller 3*a*, and the toner image on the photosensitive drum 1*a* is primarily transferred to the intermediate transfer belt 5. The drum cleaning unit 19*a* causes a cleaning blade to slide along the photosensitive drum 1*a* and collect residual toner failed to be transferred to the intermediate transfer belt 5 and remained on the photosensitive drum 1*a*.

A problem of the tandem-type image forming apparatus is that variations in speed of a plurality of the photosensitive drums or meandering movement of the intermediate transfer belt may occur due to lack of mechanical accuracy or the like. Therefore, a difference in amount of movement or the like between an outer peripheral surface of the photosensitive drum and the intermediate transfer belt at a transfer position of each image forming unit occurs at each color unevenly. Consequently, when the images are superimposed one on top of another, the images are not aligned, and hence a color shift (positional shift) of 100 to 150 μm may occur.

Accordingly, in the image forming apparatus 100, in each of the image forming units of the respective colors, a position detecting mark is formed in an electrostatic image when the image formation is not performed, and the position detecting mark is transferred to the intermediate transfer belt 5, and a belt scale reading sensor is arranged thereon to detect the position detecting mark.

The respective image forming units are controlled to correct the shift of the transferred image on the basis of a detection signal output from the belt scale reading sensor.

<Electrostatic Image Graduation>

Figure 2:
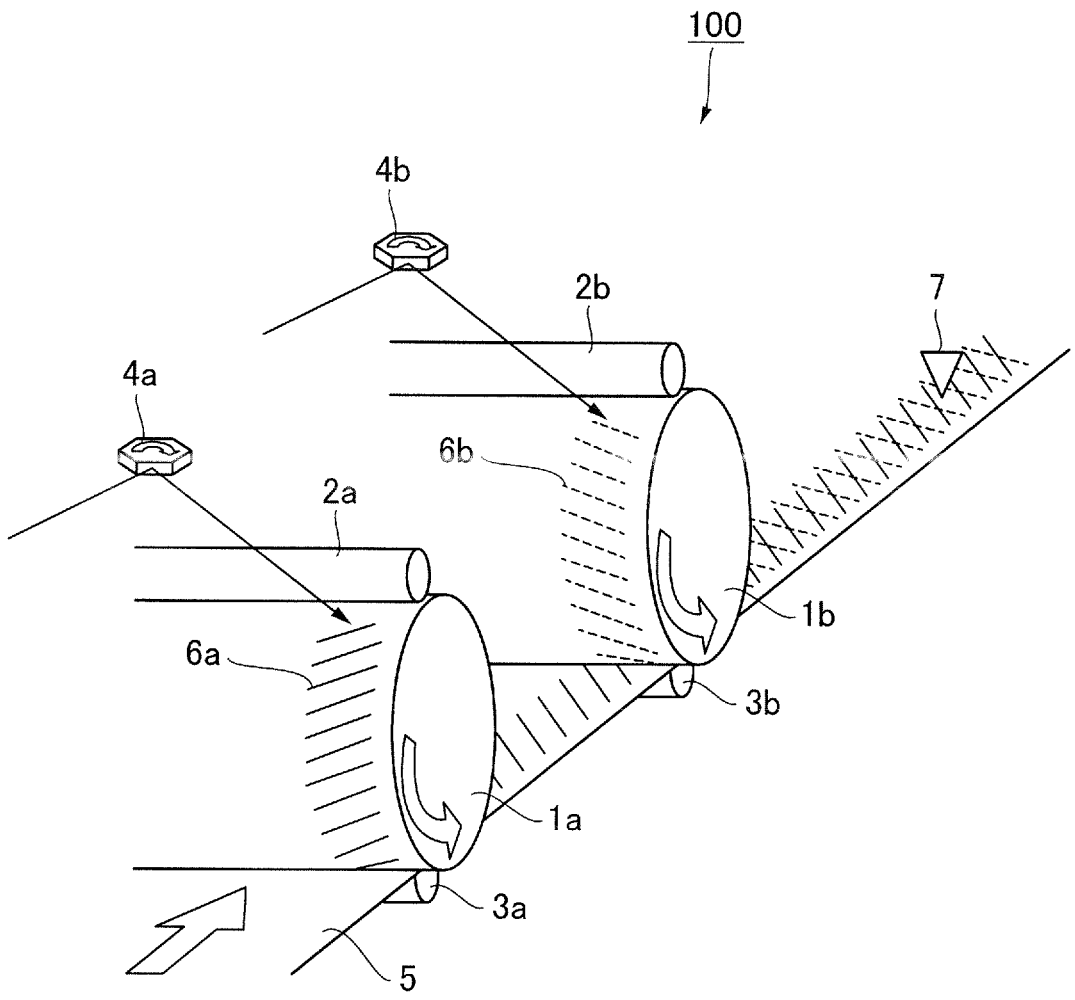
FIG. 2 is an explanatory drawing illustrating a configuration relating to a color shift correction.

FIG. 2 is an explanatory drawing illustrating a configuration relating to a color shift correction. The color shift correction in the image forming units 13*c* and 13*d* are performed in the same manner as in the image forming unit 13*b* except for the difference in color of the toner image to be corrected, so that overlapped description relating to the image forming units 13*c* and 13*d* will be omitted.

As illustrated in FIG. 2, in the image forming apparatus 100, a magenta toner image formed by the image forming unit 13*b* is primarily transferred to the intermediate transfer belt 5 so as to be superimposed on the yellow toner image formed by the image forming unit 13*a* and transferred to the intermediate transfer belt 5. At this time, positions of the yellow toner image and the magenta toner image are displaced on the intermediate transfer belt 5 due to the variations in speed of the photosensitive drums 1*a* and 1*b*, an error of exposure start timings of the exposure devices 4*a* and 4*b*, variation in speed of the intermediate transfer belt 5, and the meandering movement of the intermediate transfer belt 5, and the like. Accordingly, a so-called color shift occurs between the yellow image and the magenta image.

Therefore, in the image forming apparatus 100, the positional shift between the yellow toner image and the magenta toner image on the intermediate transfer belt 5 is reduced by using electrostatic image graduations 6*a* formed on the photosensitive drum 1*a* and electrostatic image graduations 6*b* formed on the photosensitive drum 1*b*.

In the image forming unit 13*a*, non-developing areas which are areas on both end portions of an image exposure position on the photosensitive drum 1*a* extended in a main scanning direction are provided, and the electrostatic image graduations 6*a* are written by irradiation with the laser beam before and after writing the electrostatic image of the image. The electrostatic image graduations 6*a* have a length of 3 mm in the main scanning direction of the photosensitive drum 1*a*. The electrostatic image graduations 6*a* are formed in the same manner as the electrostatic toner image of the photosensitive drum 1*a*, and hence have accurate positional information of the yellow toner image in the main scanning direction and a sub scanning direction.

In the image forming unit 13*b*, non-developing areas which are areas on both end portions of an image exposure position on the photosensitive drum 1*b* extended in the main scanning direction are provided, and the electrostatic image graduations 6*b* are written by the irradiation of the laser beam before and after writing the electrostatic image of the image. The electrostatic image graduations 6*b* each have a length of 3 mm in the main scanning direction of the photosensitive drum 1*a*. The electrostatic image graduations 6*b* are formed in the same manner as the electrostatic toner image of the photosensitive drum 1*b*, and hence have accurate positional information of the magenta toner image in the main scanning direction and the sub scanning direction.

Since developing areas of the developing devices 8*a* and 8*b* match an effective image areas, the electrostatic image graduations 6*a* and 6*b* formed on the both end portions of the photosensitive drums 1*a* and 1*b* do not subject to development by the developing devices 8*a* and 8*b*. The electrostatic image graduations 6*a* and 6*b* are started to be formed immediately after the start of drive of rotation of the photosensitive drums 1*a* and 1*b* before the electrostatic images are written on the photosensitive drums 1*a* and 1*b*, and formation is continued until the electrostatic images are completely written on the photosensitive drums 1*a* and 1*b*. The electrostatic image graduations 6*a* and 6*b* are written on scanning lines of the electrostatic image with a laser beam, and hence respective positions on the toner image obtained by developing the electrostatic image in the sub scanning direction match the positions of the electrostatic image graduations 6*a* and 6*b*.

In a first embodiment, a resolution of the image to be formed on the photosensitive drum 1*a* in the sub scanning direction is 600 dpi. A width of one scanning line is 25.4 [mm]÷600=0.423333 . . . [mm], that is, 42.3 μm. In the first embodiment, the electrostatic image graduations 6*a* and 6*b* are formed so as to include 4 lines and 4 spaces, a scale pitch is 0.338 mm which corresponds to 8 times 42.3 μm.

The electrostatic image graduations 6*a* and 6*b* are transferred to the intermediate transfer belt 5 so as to intersect each other in an overlapped manner. The electrostatic image graduations 6*a* and 6*b* transferred to the intermediate transfer belt 5 are detected by a belt scale detecting sensor 7 arranged on a downstream side of the intermediate transfer belt 5, and the positional information of each of the electrostatic image graduations 6*a* and 6*b* is acquired. On the basis of the positional information acquired from the electrostatic image graduations 6*a* and 6*b*, a position on the photosensitive drum 1*b* of the exposure device 4*b* where the main scanning is started and a timing of start of the main scanning are corrected, whereby the position where the magenta image is to be transferred is aligned with the position of the yellow image on the intermediate transfer belt 5.

In this manner, by transferring the electrostatic image graduations 6*a* and 6*b* formed by the image forming units 13*a* and 13*b* to the intermediate transfer belt 5 in the overlapped manner, the accuracy of detection of the color shift is prevented from being impaired, and a space is saved more than the case of transferring the electrostatic image graduations 6*a* and 6*b* to different positions of the intermediate transfer belt 5 in the width direction.

The electrostatic image graduations 6*a* and 6*b* on the intermediate transfer belt are detected substantially at the same timing at the same position by the belt scale detecting sensor 7 arranged on the downstream of the image forming unit 13*b*. Therefore, the accuracy of position detection is not susceptible to the variations in speed of the intermediate transfer belt 5 or vibrations of the belt scale detecting sensor 7 or the like, so that positional relationships between the electrostatic image graduations 6*a* and 6*b*, that is, the color shift may be measured accurately.

<Electrostatic Image Recording Layer>

Figure 3:
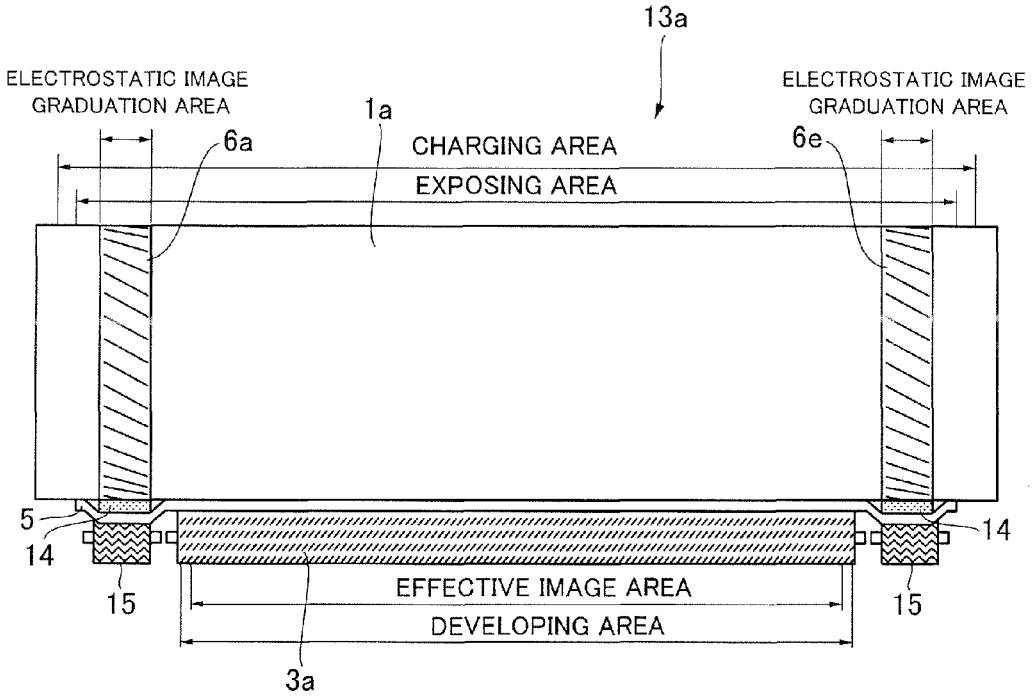
FIG. 3 is an explanatory drawing illustrating transfer of electrostatic image graduation in an image forming unit.

FIG. 3 is an explanatory drawing illustrating transfer of the electrostatic image graduation in the image forming unit. Formation and the transfer of the electrostatic image graduations at the image forming units 13*b*, 13*c* and 13*d* are executed in the same manner as at the image forming unit 13*a*, overlapped description about the image forming units 13*b*, 13*c* and 13*d* will be omitted.

As illustrated in FIG. 3, the intermediate transfer belt 5 is formed of polyimide resin in which a volume resistivity is adjusted to $10^9$ to $10^{10}$ [Ω·cm] in order to maintain transferability thereof. When the electrostatic image graduations 6*a* and 6*b* are directly transferred to the intermediate transfer belt 5, electric charge is retained once. However, since the volume resistivity is low, the electric charge is rapidly diffused, and the electrostatic image graduations 6*a* are erased before reaching the belt scale detecting sensor 7.

Therefore, electrostatic image recording layers 14 are arranged on both end portions on the front surface side of the intermediate transfer belt 5 so as to correspond to the areas on the both end portions of the photosensitive drum 1*a* where the electrostatic image graduations 6*a* are formed. The electrostatic image recording layers 14 are formed on the intermediate transfer belt 5 by adhering a sheet material having a volume resistivity different from that of the intermediate transfer belt 5. The electrostatic image recording layers 14 are PET films having a thickness of 50 μm formed into a tape having a width of 5 mm, and have a volume resistivity of $10^{14}$ [Ω·cm]. Therefore, the electric charge of the electrostatic image graduations 6*a* transferred to the electrostatic image recording layers 14 is retained without being moved, and functions as the electrostatic image graduations 6*a* on the intermediate transfer belt 5.

The electrostatic image recording layers 14 are not limited to the PET films. The electrostatic image recording layers 14 are preferably formed of a material having a high resistance not less than the volume resistivity $10^{10}$ [Ω·cm]. If the material has a volume resistivity as high as at least $10^{10}$ [Ω·cm], the electric charge of the electrostatic image graduations 6*a* is retained to the belt scale detecting sensor 7, and hence may be used as the electrostatic image graduations 6*a*. The electrostatic image recording layers 14 may be formed of fluorine contained resin material such as PTFE, or may be a resin material such as polyimide. The electrostatic image recording layers 14 may be formed by spraying the resin material or by coating the resin material and hardening the same instead of adhering the films.

<Electrostatic Image Transfer Roller>

As illustrated in FIG. 3, electrostatic image transfer rollers 15 are arranged and coupled to both ends of the primary transfer roller 3*a* so as to correspond to the electrostatic image recording layers 14 on the both end portions of the intermediate transfer belt 5. The electrostatic image transfer rollers 15 are formed of a sponge roller of a material having a volume resistivity different from the primary transfer roller 3*a*.

Portions of the intermediate transfer belt 5 where the electrostatic image recording layers 14 are arranged are formed to be relatively thicker than other portions by a thickness corresponding to the thickness of the electrostatic image recording layers 14. Therefore, the diameter of the electrostatic image transfer rollers 15 is set to be smaller than the diameter of the primary transfer roller 3*a* by 50 μm. The diameters of the electrostatic image transfer rollers 15 absorb the thickness of the electrostatic image recording layers 14, and hence conveyance by the intermediate transfer belt 5 is not affected.

A DC voltage on the order of +800 V is applied to the electrostatic image transfer rollers 15 in a state in which the electrostatic image recording layers 14 are in contact with the electrostatic image graduations 6*a* and 6*e*, respectively. Accordingly, charge patterns of the electrostatic image graduations 6*a* and 6*e* are transferred to the electrostatic image recording layers 14 respectively, and the electrostatic image graduations 6*a* and 6*e* of the intermediate transfer belt 5 are formed. The electrostatic image graduations 6*a* and the electrostatic image graduations 6*e* have the same configuration except that the direction of inclination with respect to the main scanning direction is opposite to each other. In the following description, the electrostatic image graduations 6*a* will be described, and overlapped description about the electrostatic image graduations 6*e* will be omitted.

At this time, a potential difference between exposed portions of the electrostatic image graduations 6*a* on the photosensitive drum 1*a* and the electrostatic image transfer rollers 15 is 900 V, while the potential difference between non-exposed portions of the electrostatic image graduations 6*a* on the photosensitive drum 1*a* and the electrostatic image transfer rollers 15 is on the order of 1400 V. Therefore, a larger amount of discharge occurs between the non-exposed portions of the electrostatic image graduations 6*a* and the electrostatic image recording layers 14 than between the exposed portions of the electrostatic image graduations 6*a* and the electrostatic image recording layers 14, so that a larger amount of electric charge is transferred. Accordingly, a difference in distribution of the electric charge is generated between the surfaces of the electrostatic image recording layers 14 that are in contact with the non-exposed portions of the electrostatic image graduations 6*a* and the surfaces of the electrostatic image recording layers 14 that are in contact with the exposed portions of the electrostatic image graduations 6*a*, and the electrostatic image graduations 6*a* are transferred to the electrostatic image recording layers 14.

An optimum transfer condition of the electrostatic image graduations 6*a* changes depending on the environmental variations in the same manner as in the case of transferring the toner images.

In the first embodiment, the volume resistivity of the intermediate transfer belt 5 is $10^{10}$ [Ω·cm], and the volume resistivity of the electrostatic image recording layers 14 is $10^{14}$ [Ω·cm]. The thickness of the intermediate transfer belt 5 is 50 μm. It was found as a result of experiment that the surface potential of the photosensitive drum 1*a* after the transfer of the electrostatic image graduations 6*a* was on the order of 0V in the exposed portions irradiated with the laser beam and on the order of −200 V in unexposed portions which were not irradiated with the laser beam. It was also found as a result of experiment that the electrostatic image graduations 6*a* generated by the difference in surface potential between −600V and −100V on the photosensitive drum 1*a* were transferred to the electrostatic image recording layers 14 as the electrostatic image graduations 6*a* generated by the difference in surface potential between −200 V and 0V.

In the first embodiment, the electrostatic image transfer rollers 15 formed of conductive sponge roller are used. However, a corona charger using a wire, a charger having a neutralization core used for a neutralization unit or a blade charger or the like may be used as a unit of providing electric charge when transferring the electrostatic image graduations 6*a*.

<Belt Scale Detecting Sensor>

Figure 4:
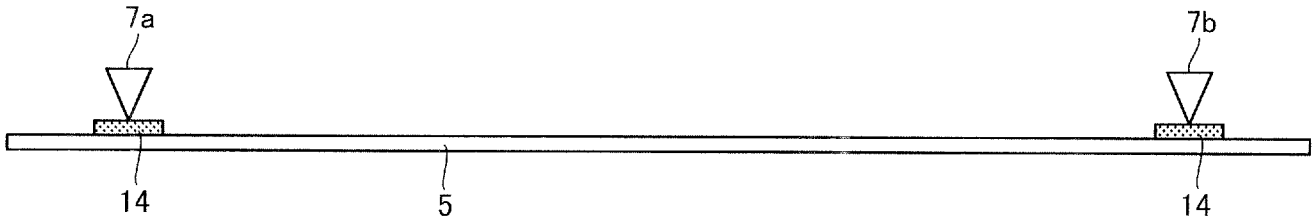
FIG. 4 is an explanatory drawing illustrating an arrangement of a belt scale detecting sensor.

FIG. 4 is an explanatory drawing illustrating an arrangement of the belt scale detecting sensor. As illustrated in FIG. 1, the belt scale detecting sensor 7 detects the electrostatic image graduations 6*a*, 6*b*, 6*c*, and 6*d* transferred respectively from the image forming units 13*a*, 13*b*, 13*c*, and 13*d* to the common electrostatic image recording layers 14 on the downstream of the downstream-most image forming unit 13*d*. As illustrated in FIG. 2, the belt scale detecting sensor 7 detects a relative positional shift of the electrostatic image graduations 6*b* (6*c*, 6*d*) transferred from the image forming unit 13*b* (13*c*, 13*d*) with respect to the electrostatic image graduations 6*a* transferred from the image forming unit 13*a*.

As illustrated in FIG. 4, a pair of the belt scale detecting sensors 7 are arranged in contact respectively with the electrostatic image recording layers 14 arranged on both sides of the intermediate transfer belt 5. A positional shift in the sub scanning direction and a positional shift in the main scanning direction are detected by detecting the electrostatic image graduations 6*a* and 6*b* on the both sides of the intermediate transfer belt 5 as described in JP-A-2001-134036. As illustrated in FIG. 2, high-precision correction of the color shift including an inclination of the toner image is achieved by detecting an angle of inclination of scanning line to be transferred at the image forming unit 13*a* and scanning line to be transferred at the image forming unit 13*b*.

In the first embodiment, the belt scale detecting sensors 7 are arranged only on the downstream of the downstream-most image forming unit 13*d*. However, the belt scale detecting sensors 7 may be arranged proximal to the image forming units 13*b*, 13*c* and 13*d* on the downstream thereof respectively. This configuration contributes to a highly precise correction of the color shift because a time length required for feedback of the positional shifts of the images at the image forming units 13*b*, 13*c* and 13*d* to the exposure devices 4*b*, 4*c*, and 4*d* is short. However, when the number of the belt scale detecting sensors 7 increases, the cost is increased correspondingly. Therefore, in the first embodiment, a configuration including only one belt scale detecting sensor 7 is arranged is selected in view of the balance between the correction accuracy and the cost.

<Configuration of Induced Current Sensor>

FIGS. 5A and 5B are explanatory drawings illustrating a configuration of an induced current sensor. FIGS. 6A and 6B are explanatory drawings illustrating detection of the electrostatic image graduation. Since the belt scale detecting sensor 7 detects the electrostatic image graduations 6*a* and 6*b* on the basis of the same principle, only the detection of the electrostatic image graduations 6*a* will be described here and overlapped description about detection of the electrostatic image graduations 6*b* is omitted.

As illustrated in FIG. 5A, the belt scale detecting sensor 7 is an induced current sensor 330 configured to detect a change of potential as described in JP-A-2007-3986. The induced current sensor 330 forms an electrode layer on abase film 332, and an L-shaped electrode pattern is formed by wet etching. As the base film 332, a polyimide flexible printed board, which is generally used for internal wiring of electric appliances, is employed in order to stably form a metallic wire having a width of 20 μm.

The induced current sensor 330 has an L-shaped conducting wire 331 formed of a metallic wire having a width of 20 μm on the base film 332 having a width of 4 mm, a height of 15 mm, and a thickness of 25 μm. A straight portion of a length of approximately 2 mm of the conducting wire 331 at a distal end side corresponds to a detecting portion 334. The detecting portion 334 is connected to an output portion 335 for signals. An end of the L-shaped conducting wire 331 on the side opposite to the detecting portion 334 corresponds to the output portion 335.

As illustrated in FIG. 5B, a protecting film 333 having the same size and thickness as the base film 332 formed of a polyimide film is adhered over the L-shaped conducting wire 331. An adhesive agent exists mainly between the base film 332 and the protecting film 333. Since the adhesive agent does not exist between the conducting wire 331 and the base film 332, the distance between a surface of the base film 332 being in contact with the electrostatic image and a surface of the conducting wire 331 is defined equally to 25 μm.

As illustrated in FIG. 6A, the electrostatic image graduations 6*a* transferred to the electrostatic image recording layer 14 include high-potential portions 341 having a relatively high potential and being expressed in black color and low-potential portions 342 having a relatively low potential and being expressed in white color. The induced current sensor 330 used as a belt scale reading sensor 33*b* is fixed to a housing of the image forming unit 13*b* at an end on a root side so that the detecting portion 334 and the electrostatic image graduations 6*a* extend in parallel to each other. The induced current sensor 330 is fixed at the end on the root side to the housing of the image forming unit 13*b* so that the detecting portion 334 and an electrostatic image graduation line 31*b* extend in parallel to each other. At the image forming units 13*c* and 13*d* as well, the induced current sensor 330 is fixed in the same manner.

As illustrated in FIG. 6B, the induced current sensor 330 causes a supporting portion, which is not illustrated, to hold the root side thereof, and is curbed as a whole so as to cause the base film 332 to slide along the electrostatic image recording layer 14. Since the base film 332 side comes into contact with the electrostatic image recording layer 14 by being urged by bending elasticity of the induced current sensor 330, the space between the conducting wire which functions as the detecting portion 334 and the electrostatic image recording layer 14 is always kept constant in association with a sliding movement. A configuration in which a portion of the induced current sensor 330 on the base film 332 side may be pressed against the electrostatic image recording layer 14 by pressing with a spring, which is not illustrated, from above the protecting film 333 is also applicable.

<Output of Induced Current Sensor>

Figures 7A, 7B, 7C:
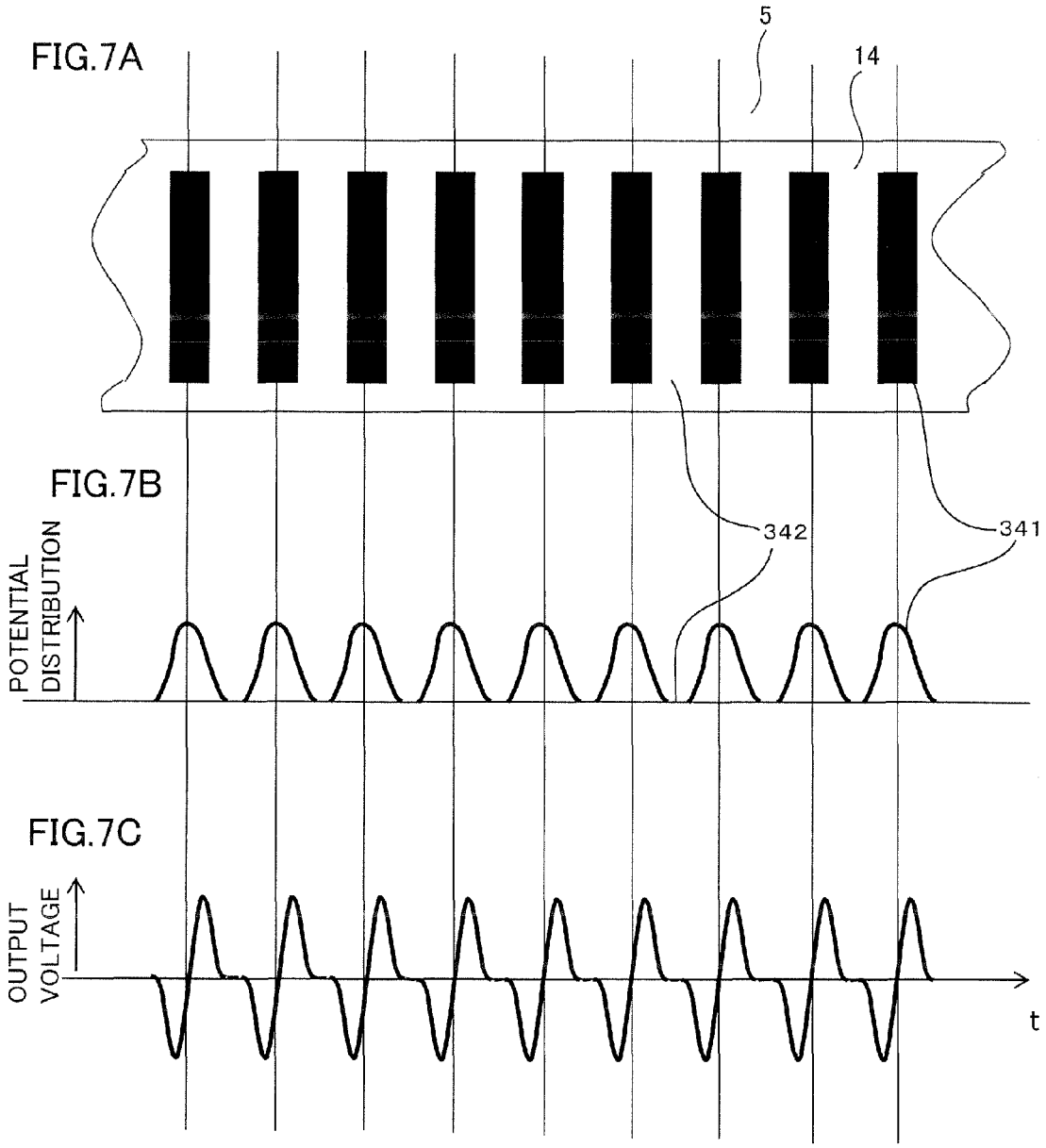
FIG. 7A is a schematic drawing illustrating the electrostatic image graduation including 8 lines and 8 spaces.
FIG. 7B is a schematic drawing illustrating an actual potential distribution of the electrostatic image graduation illustrated in FIG. 7A.
FIG. 7C is a graph illustrating an output signal when the induced current sensor detects the electrostatic image graduation illustrated in FIG. 7A.
Figures 8A, 8B, 8C:
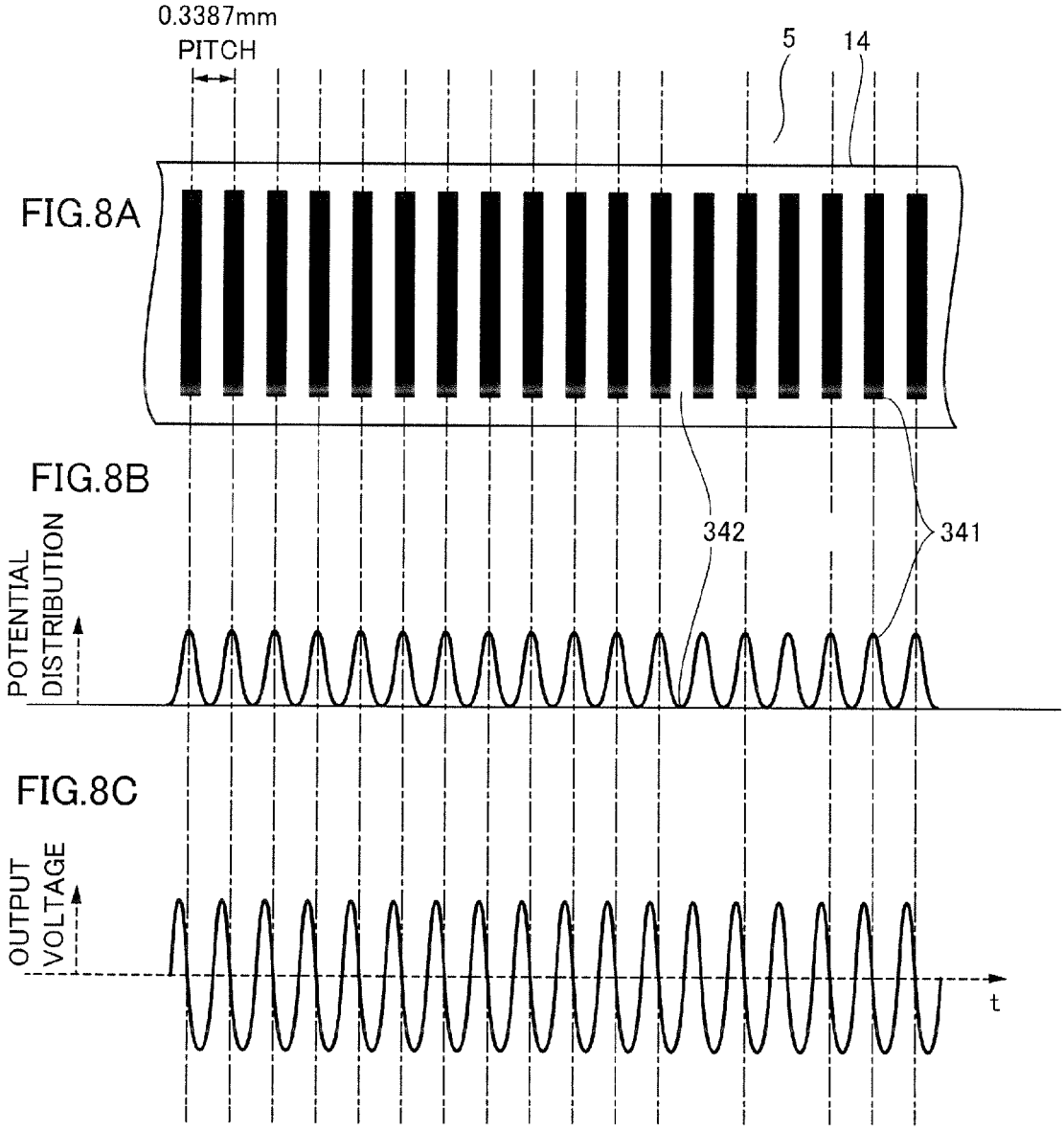
FIG. 8A is a schematic drawing illustrating the electrostatic image graduation including 4 lines and 4 spaces.
FIG. 8B is a schematic drawing illustrating an actual potential distribution of the electrostatic image graduation illustrated in FIG. 8A.
FIG. 8C is a graph illustrating an output signal when the induced current sensor detects the electrostatic image graduation illustrated in FIG. 8A.

FIGS. 7A, 7B, and 7C are explanatory drawings illustrating detection signals of the induced current sensor at the electrostatic image graduation including 8 lines and 8 spaces. FIGS. 8A, 8B, and 8C are explanatory drawings illustrating detection signals of the induced current sensor at the electrostatic image graduation including 4 lines and 4 spaces.

As illustrated in FIG. 7A, the electrostatic image graduations 6*a* have an image resolution of 600 dpi (0.04233 mm) and is an incremental pattern of 8 lines and 8 spaces (pitch 0.6773 mm) repeating exposure for an amount corresponding to 8 lines and non-exposure for an amount corresponding to 8 lines. The electrostatic image graduations 6*a* transferred to the electrostatic image recording layer 14 have a distribution of electric charge in which the high-potential portions 341 and the low-potential portions 342 appear alternately. In the first embodiment, the exposed portions of the photosensitive drum 1*a* are transferred to the low-potential portions 342, and the surface potential thereof is on the order of 0V. The non-exposed portions of the photosensitive drum 1*a* are transferred to the high-potential portions 341 and the surface potential thereof is on the order of −200V.

As illustrated in FIG. 7B, an actual potential distribution of the electrostatic image graduations 6*a* is not appeared in a rectangular wave because the amount of exposure by the laser beam has a distribution and is reduced in a peripheral area, but is appeared in a potential distribution of a Sine curve. When the induced current sensor 330 is moved in the direction of the change of the potential in an area where the potential distribution exists as described above, the potential in the vicinity of the detecting portion 334 of the induced current sensor 330 changes and an induced current is generated.

At this time, as illustrated in FIG. 7C, an output signal having a waveform obtained by differentiating the potential distribution of the electrostatic image graduations 6*a* is output from the output portion 335 of the induced current sensor 330. Since a pitch of the electrostatic image graduation is coarse, there are time intervals to some extent from generation of the potential change to generation of the next potential change, the output signal from the induced current sensor 330 has a shape different from a sinusoidal wave.

As illustrated in FIG. 8A, the electrostatic image graduations 6*a* have the image resolution of 600 dpi (0.04233 mm) and is an incremental pattern of 4 lines and 4 spaces (pitch 0.3387 mm) repeating exposure for an amount corresponding to 4 lines and non-exposure for an amount corresponding to 4 lines.

As illustrated in FIG. 8C, in a case of 4 lines and 4 spaces (pitch 0.3387 mm), which was half of 8 lines and 8 spaces (pitch 0.6773 mm), an output of an induced current sensor was a sinusoidal wave. Since peak (inclination of 0) points of the potential distribution come to centers of scales, timings when an output voltage becomes zero correspond to timings when the scales are detected.

<Color Shift Correction System>

Figure 9:
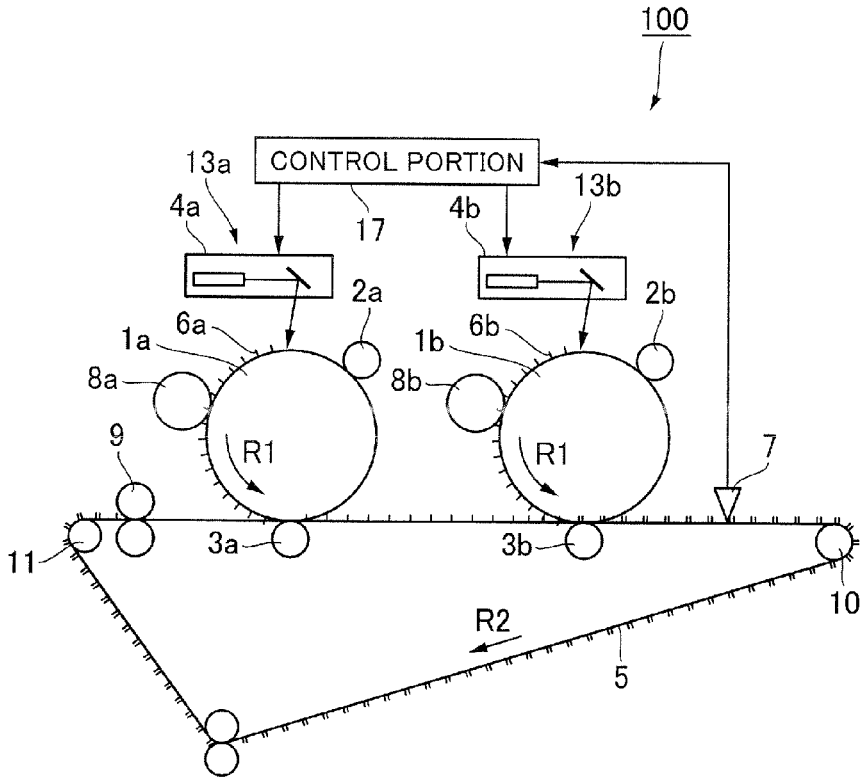
FIG. 9 is a block diagram for explaining color shift correction control of a first embodiment.
Figure 10:
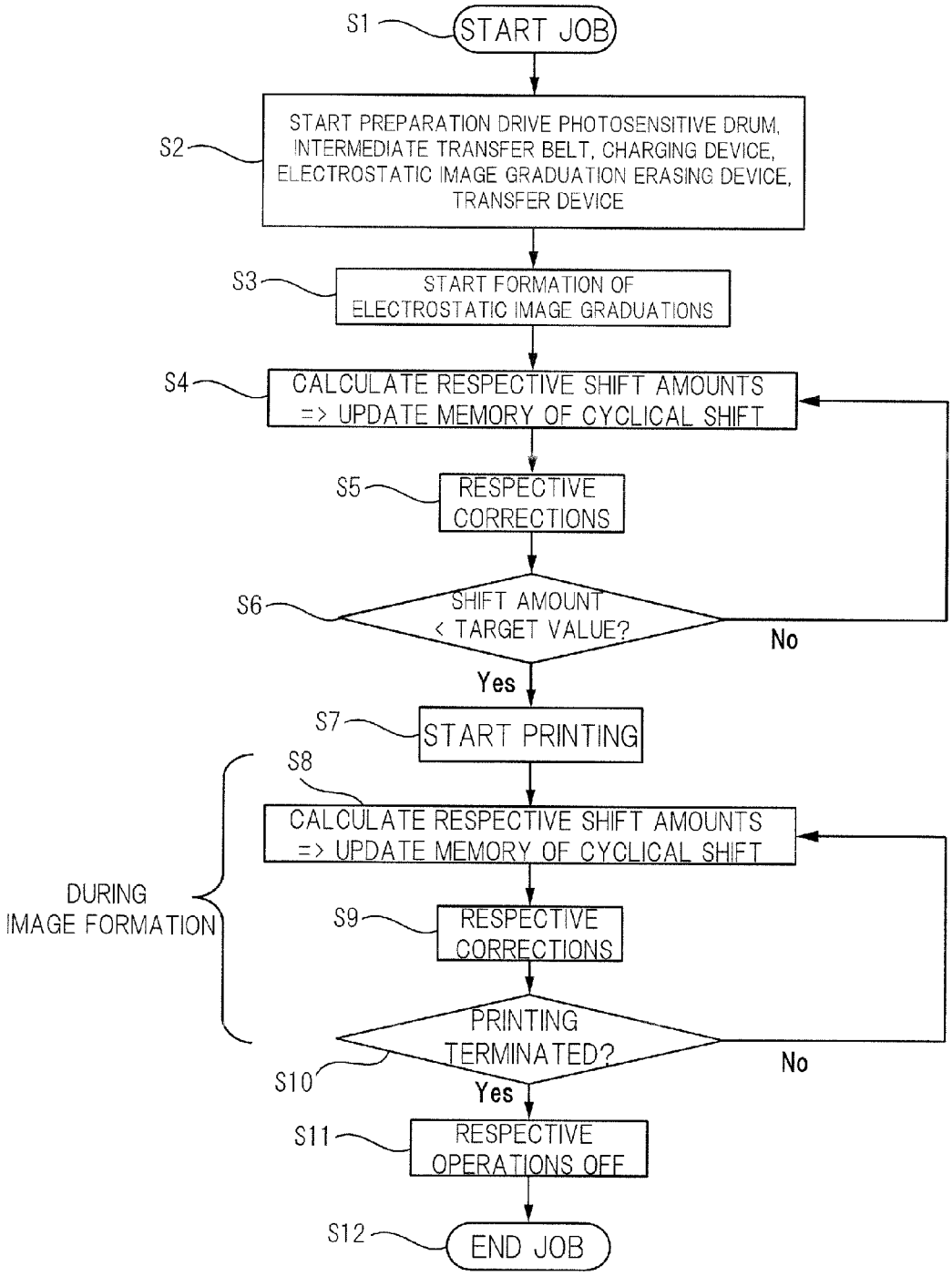
FIG. 10 is a flowchart of the color shift correction control of the first embodiment.

FIG. 9 is a block diagram of a color shift correction control of the first embodiment. FIG. 10 is a flowchart of the color shift correction control of the first embodiment. As described above, the color shift correction control of the image forming units 13*c* and 13*d* are the same as the image forming unit 13*b*, the image forming unit 13*b* will be described and overlapped description about the image forming units 13*c* and 13*d* will be omitted.

As shown in FIG. 10 with reference to FIG. 9, when the control portion 17 receives an image forming job (S1), preparatory operation is started (S2). The photosensitive drums 1*a* and 1*b*, the charging rollers 2*a* and 2*b*, the primary transfer rollers 3*a* and 3*b*, intermediate transfer belt 5, and an electrostatic image graduation erasing roller 9 are driven to start a charging operation of the photosensitive drums 1*a* and 1*b* (S2).

The control portion 17 forms the electrostatic image graduations 6*a* on the photosensitive drum 1*a* at the image forming unit 13*a*, and transfers the electrostatic image graduations 6*a* to the electrostatic image recording layer (14: FIG. 2) on the intermediate transfer belt 5. At the same time, the control portion 17 forms the electrostatic image graduations 6*b* on the photosensitive drum 1*b* at the image forming unit 13*b*, and transfers the electrostatic image graduations 6*b* to the electrostatic image recording layer (14: FIG. 2) on the intermediate transfer belt 5 (S3).

The control portion 17 detects the positions of the electrostatic image graduations 6*a* and 6*b* on the intermediate transfer belt 5 by the belt scale detecting sensors 7, and detects an amount of positional shift of the electrostatic image graduations 6*b* with respect to the electrostatic image graduations 6*a*. The control portion 17 obtains an amount of the color shift of the image formed on the photosensitive drum 1*b* on the basis of the results of detection of the belt scale detecting sensors 7 and calculates an amount of correction of the positional shift to be set to the exposure device 4*b* (S4).

The control portion 17 calculates an amplitude and a phase of the cyclical color shift from the results of measurement of the amount of color shift over a plurality of rotations of the intermediate transfer belt 5. The amount of correction of the cyclical color shift is stored in a memory (S4), and is used for the cyclical color shift correction at the exposure device 4*b*.

Subsequently, the control portion 17 performs correction in accordance with the amount of correction (S5). The amount of correction at a leading position of the image in the main scanning direction and the sub scanning direction to be set to the exposure device 4*b* in accordance with the calculated amount of color shift is calculated, and the exposure timing of the exposure device 4*b* is corrected. Alternatively, a correction is performed so that the image data exposed by the exposure device 4*b* is shifted in the main scanning direction and the sub scanning direction.

The control portion 17 forms the electrostatic image graduations 6*a* and 6*b* again on the photosensitive drums 1*a* and 1*b* after the correction, transfers the electrostatic image graduations 6*a* and 6*b* to the intermediate transfer belt 5, and then measures the amount of color shift by the belt scale detecting sensors 7 (S6). The measurement and the adjustment are repeated (S4) until the amount of color shift is reduced to a level lower than a target value (No in S6).

When the amount of color shift is reduced to a level lower than the target value (Yes in S6), the control portion 17 starts the image formation (S7). Even after the image formation has started, the control portion 17 forms the electrostatic image graduations 6*a* and 6*b* on the photosensitive drums 1*a* and 1*b*, transfers the electrostatic image graduations 6*a* and 6*b* to the intermediate transfer belt 5, and measures the amount of color shift (S8), and repeats the correction (S9).

When the image formation is ended (Yes in S10), the control portion 17 stops respective operations of the image forming apparatus 100 (S11), and ends the image forming job (S12).

According to the color shift correction control of the first embodiment, since the amount of color shift is always measured and continuously corrected even during the image formation, a high-quality image with less color shift may be provided for users. According to the color shift correction control of the first embodiment, since the electrostatic image graduations 6*a* and 6*b* are used, the toner is not wasted in the color shift correction control and hence the amount of toner consumption is saved. According to the color shift correction control of the first embodiment, since the continuous image formation needs not to be stopped for the color shift correction, down time of the image forming apparatus 100 is short, and hence the productivity does not drop.

COMPARATIVE EXAMPLE

FIGS. 11A and 11B are explanatory drawings of an electrostatic image graduation of Comparative Example 1. FIGS. 12A and 12B are explanatory drawings of an electrostatic image graduation of Comparative Example 2. FIG. 11A and FIG. 12A illustrate arrays, and FIG. 11B and FIG. 12B illustrate detected signals detected by the induced current sensor. The electrostatic image graduations 6*a* and 6*b* formed at the image forming units 13*a* and 13*b* are transferred to the common electrostatic image recording layer 14, whereby a space for the electrostatic image recording layer 14 in the main scanning direction of the intermediate transfer belt 5 may be saved. As described above, in the first embodiment, the electrostatic image graduations 6*a* and 6*b* are superimposed one on top of another so as to intersect on the electrostatic image recording layer 14. However, an array of the electrostatic image graduations 6*a* and 6*b* arranged alternately in parallel is also conceivable.

As illustrated in FIG. 11A, the electrostatic image graduations 6*a* and 6*b* of Comparative Example 1 are formed in parallel to each other at regular pitches. One line of the electrostatic image graduations 6*a* and one line of the electrostatic image graduations 6*b* are parallel to each other. The electrostatic image graduations 6*a* and 6*b* are formed so that the patterns are not overlapped repeatedly and alternately even when the maximum positional shift occurs.

For example, when the electrostatic image graduations 6*a* and 6*b* each are formed aiming at a pitch P=0.3387 mm, the electrostatic image graduations 6*a* and 6*b* are arrayed alternately without being overlapped completely as long as the color shift of the image forming apparatus 100 is within a range from 100 to 150 μm in the sub scanning direction. However, in this configuration, the conducting wire 331 of the induced current sensor 330 detects the electrostatic image graduations 6*a* and the electrostatic image graduations 6*b* alternately, the output pulse from the induced current sensor 330 needs to be identified whether the signal indicating detection of the electrostatic image graduations 6*a* or the electrostatic image graduations 6*b*.

A first method of separating signals is to separate the signals on the basis of timing. As illustrated in FIG. 11B, before forming the electrostatic image graduations 6*a* and 6*b* by the exposure units 4*a* and 4*b*, a signal waiting state is provided. Subsequently, a threshold voltage for detecting the pulsed signal is provided, and a signal which exceeds the threshold voltage for the first time is determined to be the electrostatic image graduation 6*a*. As illustrated in FIG. 11A, separation of the signals is achieved by setting the electrostatic image graduations 6*a* and the electrostatic image graduations 6*b* to be repeated alternately, and recognizing the signals in sequence from the electrostatic image graduation 6*a* which is detected for the first time so as to repeat the electrostatic image graduations 6*a* and the electrostatic image graduations 6*b*.

A second method of separating signals is to separate the signals on the basis of the intensity of the output signal. As illustrated later, the potentials of the electrostatic image graduations 6*a* and 6*b* may be differentiated by differentiating a DC voltage to be applied to the electrostatic image transfer rollers 15 when the electrostatic image graduations 6*a* and 6*b* are transferred to the electrostatic image recording layers 14. For example, when the DC voltage to be applied to the electrostatic image transfer rollers 15 is 1000 V, the potential of the high-potential portions of the electrostatic image graduations 6*a* and 6*b* is −160V. However, when the DC voltage is 700V, the potential of the high-potential portions of the electrostatic image graduations 6*a* and 6*b* is −10V (see FIG. 18). Then, the difference in potential between the electrostatic image graduations 6*a* and 6*b* appears as the difference in intensity of the output signal when being detected by the induced current sensor 330.

As illustrated in FIG. 12A, if the potential of the high-potential portion of the electrostatic image graduations 6*b* is set to be larger in the negative direction than the potential of the high-potential portion of the electrostatic image graduations 6*a*, the signal intensity at the time of detection of the electrostatic image graduations 6*a* is larger than the signal intensity at the time of detection of the electrostatic image graduations 6*b*. Therefore, as illustrated in FIG. 12B, threshold voltages of th1 and th2 are provided, a signal that exceeds th1 and th2 is recognized as the electrostatic image graduations 6*a*, and a signal that exceeds th2 and does not exceed th1 is recognized as the electrostatic image graduations 6*b*. Accordingly, separation of the signals is enabled.

In Comparative Example 2, since the signals are separated on the basis of the output signal intensity, even though the electrostatic image graduations 6*a* and the electrostatic image graduations 6*b* are significantly shifted due to a sudden variation and are overlapped or overtaken, separation of the both signals are achieved. However, since two threshold voltages need to be provided for performing an analogue process, a signal processing circuit becomes further complicated, the response speed is lowered, and cost is increased.

According to Comparative Examples 1 and 2, since the electrostatic image graduations 6*a* and 6*b* are arranged alternately, positional information that can be obtained from a unit length of the intermediate transfer belt 5 is reduced by half in comparison with the case where only the electrostatic image graduations 6*a* are arranged at a regular pitch. Therefore, there arises a problem that the number of times of the color shift correction that can be performed per unit time is reduced, and the registration accuracy of image is lowered.

Therefore, in the first embodiment, the electrostatic image graduations 6*a* and 6*b* are overlapped so as to intersect each other and transferred to the electrostatic image recording layers 14, so that the electrostatic image graduations 6*a* and 6*b* are arrayed at a high density and the positional information that can be obtained from a unit length of the intermediate transfer belt 5 is increased.

<Characteristic Points of First Embodiment>

Figure 13:
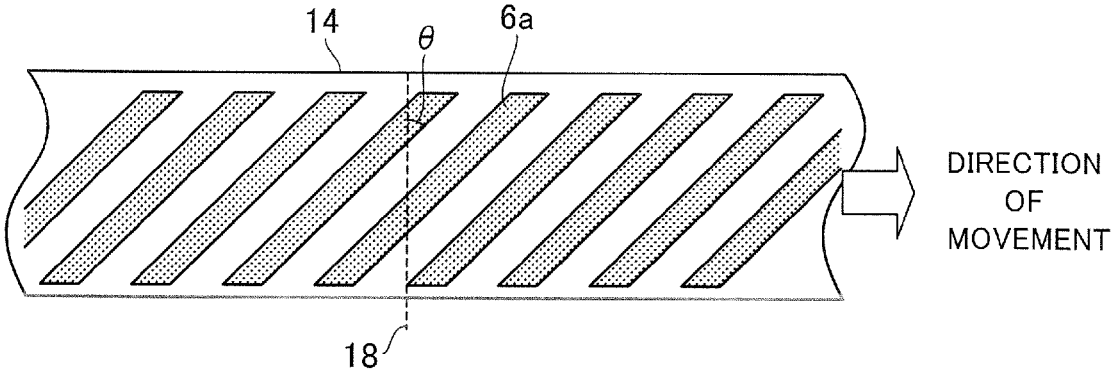
FIG. 13 is an explanatory drawing illustrating an electrostatic image graduation on an electrostatic image recording layer of the first embodiment.
Figure 14:
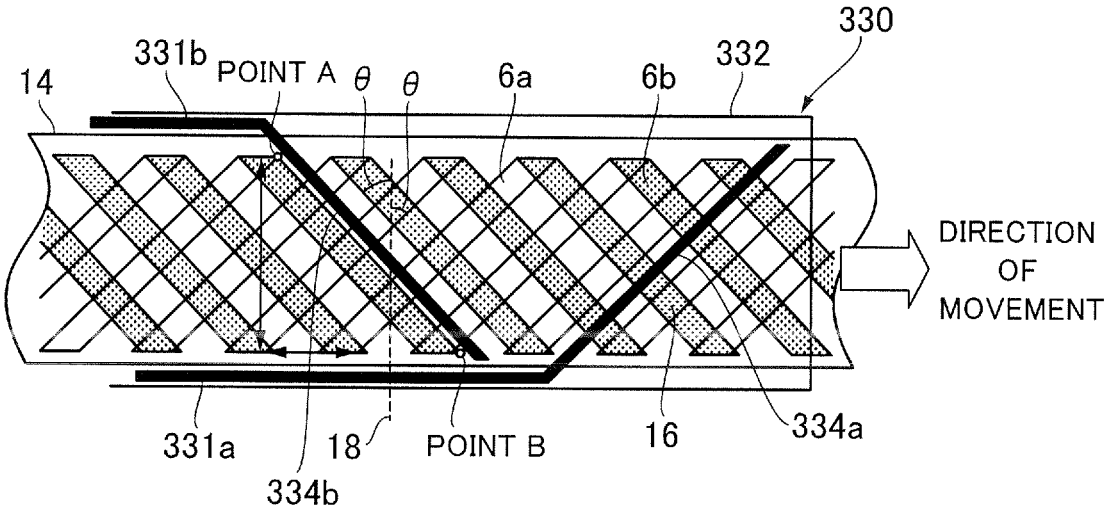
FIG. 14 is an explanatory drawing illustrating an arrangement of an induced current sensor of the first embodiment.
Figure 15:
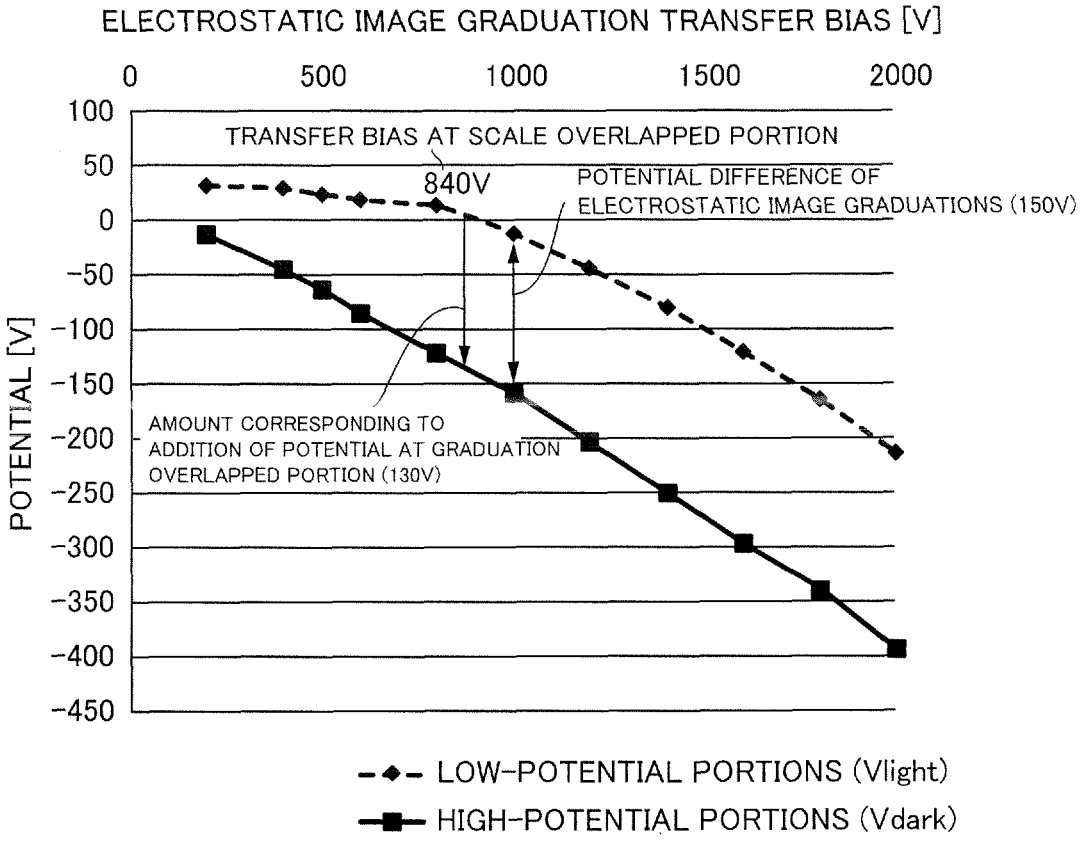
FIG. 15 is an explanatory drawing illustrating a relationship between a transfer voltage and a potential of the transferred electrostatic image graduation.
Figure 17:
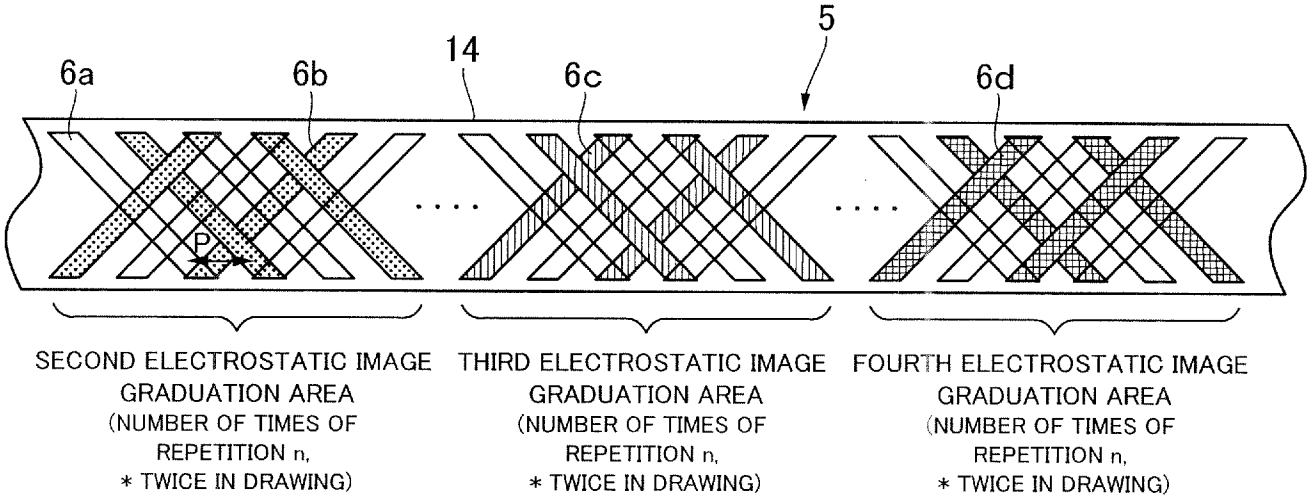
FIG. 17 is an explanatory drawing illustrating an arrangement of the electrostatic image graduation in four-color color shift adjustment.

FIG. 13 is an explanatory drawing illustrating the electrostatic image graduation on the electrostatic image recording layer of the first embodiment. FIG. 14 is an explanatory drawing illustrating an arrangement of the induced current sensor of the first embodiment. FIG. 15 is an explanatory drawing illustrating a relationship between a transfer voltage and a potential of the transferred electrostatic image graduation. FIGS. 16A and 16B are explanatory drawings of a potential state of respective portions of intersecting electrostatic image graduation. FIG. 17 is an explanatory drawing illustrating an arrangement of the electrostatic image graduation in four-color color shift adjustment.

As illustrated in FIG. 1, the intermediate transfer belt 5, which is an example of a conveying member is configured to convey a toner image transferred from the photosensitive drum 1*a*, which is an example of a first photosensitive member, to the photosensitive drum 1*b*, which is an example of a second photosensitive member. A plurality of the photosensitive drums 1*b*, 1*c*, and 1*d* are arranged in the direction of movement of the intermediate transfer belt 5. The electrostatic image graduations are transferred individually from the plurality of photosensitive drums to different positions respectively in the sub scanning direction on a line of the electrostatic image graduations 6*a* transferred from the photosensitive drum 1*a* to the intermediate transfer belt 5. As illustrated in FIG. 9, the belt scale detecting sensor 7 is arranged on the downstream of the photosensitive drum 1*b* in the direction of movement of the intermediate transfer belt 5.

As illustrated in FIG. 9, the exposure device 4*a*, which is an example of a first exposure unit, forms the electrostatic image graduations 6*a*, which are an example of a linear first electrostatic image index that is inclined by a first angle from the main scanning direction, on the photosensitive drum 1*a*. The exposure device 4*b*, which is an example of a second exposure unit, forms the electrostatic image graduations 6*b*, which are an example of a linear second electrostatic image index that is inclined by a second angle different from the first angle from the main scanning direction, on the photosensitive drum 1*b*. The electrostatic image transfer roller 15*a*, which is an example of a first transfer portion, transfers the electrostatic image graduations 6*a* formed on the photosensitive drum 1*a* to the intermediate transfer belt 5. The electrostatic image transfer roller 15*b*, which is an example of a second transfer portion, transfers the electrostatic image graduations 6*b* formed on the photosensitive drum 1*b* so as to overlap with the electrostatic image graduations 6*a* that are transferred on the intermediate transfer belt 5.

As illustrated in FIG. 14, a Ch1 conducting wire 331*a* and a Ch2 conducting wire 331*b* are arranged on the belt scale detecting sensors (7, FIG. 9). The Ch1 conducting wire 331*a*, which is an example of a first detection portion, includes a detecting portion 334*a*, which is an example of a linear conductive member inclined from the main scanning direction of the intermediate transfer belt 5 by a first angle, and detects an induced current of the electrostatic image graduations 6*a* transferred to the intermediate transfer belt 5. The Ch2 conducting wire 331*b*, which is an example of a second detection portion, includes a detecting portion 334*b*, which is an example of a linear conductive member inclined from the main scanning direction of the intermediate transfer belt 5 by a second angle, and detects an induced current of the electrostatic image graduations 6*b* transferred to the intermediate transfer belt 5.

As illustrated in FIG. 9, the control portion 17, which is an example of an execution unit, is configured to execute a detection mode when the image formation is not performed. In the detection mode, the electrostatic image graduations 6*a* and the electrostatic image graduations 6*b* are formed and are transferred to the intermediate transfer belt 5, and are detected by the Ch1 conducting wire 331*a* and the Ch2 conducting wire 331*b*. The control portion 17, which is an example of an adjusting unit, adjusts the position of formation of the toner image in the sub scanning direction at least at one of the photosensitive drum 1*a* and the photosensitive drum 1*b* on the basis of the result of detection in the detection mode.

As illustrated in FIG. 13, the electrostatic image graduations 6*a* formed on the photosensitive drum (1*a*, FIG. 2) and transferred to the electrostatic image recording layer 14 are inclined so that the longitudinal directions thereof form an angle θ with respect to the main scanning direction. FIG. 13 is a drawing illustrating a potential distribution on the electrostatic image recording layer 14 after the electrostatic image graduations 6*a* are transferred to the electrostatic image recording layer 14 by the image forming unit 13*a*.

As illustrated in FIG. 14, unlike the comparative examples given above, the electrostatic image graduations 6*b* overlapped on the electrostatic image graduations 6*a* that are transferred to the electrostatic image recording layer 14 in an intersecting manner and formed on the photosensitive drum (1*b*, FIG. 2) are transferred to the electrostatic image recording layer 14. The electrostatic image graduations 6*b* are inclined so that the longitudinal directions thereof form an angle −θ with respect to the main scanning direction.

In order to detect the electrostatic image graduations 6*a* and 6*b*, an induced current sensor 330 having the two independent detecting portions 334*a* and 334*b* is used. The induced current sensor 330 includes the Ch1 conducting wire 331*a* having the detecting portion 334*a* parallel to the electrostatic image graduations 6*a* and the Ch2 conducting wire 331*b* having the detecting portion 334*b* parallel to the electrostatic image graduations 6*b* formed on a common base film 332.

In the first embodiment, like Comparative Examples 1 and 2, since the electrostatic image graduations 6*a* and 6*b* are not separated, an induced current generated by the electrostatic image graduations 6*b* may be mixed with a detection signal from the Ch1 conducting wire 331*a*. When an induced current of the electrostatic image graduations 6*b* is generated in the Ch1 conducting wire 331*a* for detecting the electrostatic image graduations 6*a*, noise is generated, and hence the positions of the electrostatic image graduations 6*a* cannot be detected accurately. The same applies to the Ch2 conducting wire 331*b*. In other words, it is preferable that the Ch1 conducting wire 331*a* does not detect the electrostatic image graduations 6*b*, and the Ch2 conducting wire 331*b* does not detect the electrostatic image graduations 6*a*, respectively.

In order to prevent the Ch1 conducting wire 331*a* from detecting the electrostatic image graduations 6*b*, the surface area of a part of the electrostatic image graduations 6*b* immediately below the detecting portion 334*a* of the Ch1 conducting wire 331*a* needs to be constant even when the electrostatic image graduations 6*b* move. If the surface area of the part of the electrostatic image graduations 6*b* passing through the detecting portion 334*a* is constant, an induced current caused by the electrostatic image graduations 6*b* is not generated in the Ch1 conducting wire 331*a*. A conditional equation of a constant surface area of the part of the electrostatic image graduations 6*b* passing through the detecting portion 334*a* is expressed by the following equation. The conditions of the following equation are also conditions for prevention of detection of the electrostatic image graduations 6*a* by the Ch2 conducting wire 331*b*.

$$\frac{np}{2} = W \times \tan\theta (n \text{ is an integer}) \quad \text{Eq. 1}$$

As a detailed example, a relationship of nP/2=W×tan θ (n is an integer) is satisfied with W=12×0.3387 mm/2=2.0322 mm, where P=0.3387 mm, θ=45°, and n=12. In addition, in the first embodiment, the electrostatic image graduations 6*b* (6*a*) are designed as follows.

(1) The longitudinal direction of the detecting portion 334*a* of the Ch1 conducting wire 331*a* is the longitudinal direction of the electrostatic image graduations 6*a*, and the length of the Ch1 conducting wire 331*a* is longer than the length of the electrostatic image graduations 6*a*.

(2) The width W, the angle θ, and the pitch P of the electrostatic image graduations 6*a* and 6*b* are determined so that the electrostatic image graduations 6*b* connect acute angle apexes (points A) at one of the ends of the respective electrostatic image graduations 6*a* and obtuse angle apexes (points B) at the other ends thereof.

(3) The electrostatic image graduations 6*a* and 6*b* have the same pitch P and the same line width W.

(4) Each of the electrostatic image graduations 6*a* has a shape of parallelogram having two ends in the longitudinal direction extending in parallel to the sub scanning direction.

(5) Each of the electrostatic image graduations 6*b* has a shape of parallelogram having two ends in the longitudinal direction extending in parallel to the sub scanning direction, and having the same bottom length and the height as the electrostatic image graduations 6*a*.

As illustrated in FIG. 15 with reference to FIG. 3, a DC voltage to be applied to the electrostatic image transfer roller 15*a* was changed when transferring the electrostatic image graduations 6*a* to the electrostatic image recording layer 14, and potentials of the high-potential portions and the low-potential portions of the electrostatic image graduations 6*a* that have been transferred to the electrostatic image recording layer 14 were measured.

The low-potential portions of the electrostatic image graduations 6*a* were formed of portions exposed on the photosensitive drum 1*a* transferred to the electrostatic image recording layer 14, and the high-potential portions were formed of portions not exposed on the photosensitive drum 1*a* transferred to the electrostatic image recording layer 14.

The potential of the high-potential portions was increased in the negative direction substantially in proportion to a transfer bias of the electrostatic image graduations. In contrast, the potential of the low-potential portions had substantially no change until the transfer bias of the electrostatic image graduations reaches a value on the order of +900V, and, when the transfer bias of the electrostatic image graduations was further increased, the potential of the low-potential portions was increased in the negative direction in proportion thereto.

For example, when the electrostatic image graduations 6*a* of the photosensitive drum 1*a* is transferred to the electrostatic image recording layer 14 at a DC voltage of +1000V, the voltage of the high-potential portions was −160V, the voltage of the low-potential portion was −10V, and the potential difference between the high-potential portion and the low-potential portion was 150V.

Subsequently, the electrostatic image graduations 6*b* on the photosensitive drum 1*b* were transferred to the electrostatic image recording layer 14 where the electrostatic image graduations 6*a* were already transferred by using the same transfer DC voltage of +1000V. At this time, according to a common sense, the electrostatic image graduations 6*a* which were already transferred were hindered, and the potential difference between the high-potential portions and the low-potential portions of the electrostatic image graduations 6*a* was considered to be reduced. However, the result of the experiment was the other way round, and it was found that the potential difference between the high-potential portions and the low-potential portions of the electrostatic image graduations 6*a* was maintained. The result of the experiment described thus far is a reason why the electrostatic image graduations 6*a* and the electrostatic image graduations 6*b* are formed so as to intersect each other in the first embodiment.

The electrostatic image graduations 6*b* are formed by electric discharge occurring at a potential which is a sum of the DC voltage of +1000V applied to the electrostatic image transfer rollers 15*b* and the potential of the electrostatic image graduations 6*a*. The transfer potential difference of the electrostatic image graduations 6*b* at the low-potential portions (−10V) of the electrostatic image graduations 6*a* corresponds to 1000V+(−10V)=+990V. As illustrated in FIG. 15, when the electrostatic image graduations 6*b* are transferred at a transfer potential difference of +990V, a potential of −10V is added to portions of the electrostatic image recording layer 14 which are in contact with the low-potential portions of the electrostatic image graduations 6*b*, and a potential of −150V is added to the portions of the electrostatic image recording layer 14 which are in contact with the high-potential portions. The potential of the low-potential portions of the electrostatic image graduations 6*a* is −10V, and hence the potential of the electrostatic image graduations 6*b* is formed as given below.

(E1): A potential of portions which correspond both to the low-potential portions of the electrostatic image graduations 6*a* and the low-potential portions of the electrostatic image graduations 6*b* is −10V+(−10V)=−20V.

(E2): A potential of portions which correspond both to the low-potential portions of the electrostatic image graduations 6*a* and the high-potential portions of the electrostatic image graduations 6*b* is −10V+(−150V)=−160V.

In contrast, the transfer potential difference of the electrostatic image graduations 6*b* at the high-potential portions (−160V) of the electrostatic image graduations 6*a* corresponds to 1000V+(−160V)=+840V. As illustrated in FIG. 15, when the electrostatic image graduations 6*b* are transferred at a transfer potential difference of +840V, a potential of 0V is added to portions of the electrostatic image recording layer 14 which are in contact with the low-potential portions of the electrostatic image graduations 6*b*, and a potential of −130V is added to the portions of the electrostatic image recording layer 14 which are in contact with the high-potential portions thereof. The potential of the high-potential portions of the electrostatic image graduations 6*a* is −160V, and hence the potential of the electrostatic image graduations 6*b* is formed as given below.

(E3): A potential of portions which correspond both to the high-potential portions of the electrostatic image graduations 6*a* and the low-potential portions of the electrostatic image graduations 6*b* is −160V+0V=−160V.

(E4): A potential of portions which correspond both to the potential of the high-potential portions of the electrostatic image graduations 6*a* and the high-potential portions (=portions where the scales are overlapped) of the electrostatic image graduations 6*b* is −160V+(−130V)=−290V.

As illustrated in FIG. 16A, potentials of the respective portions (E1 to E4) where the electrostatic image graduations 6*a* and 6*b* are overlapped were confirmed. The portions E4 where the electrostatic image graduations 6*a* and 6*b* are overlapped correspond to portions where the high-potential portions of the electrostatic image graduations 6*a* and the high-potential portions of the electrostatic image graduations 6*b* are overlapped with each other. The portions E4 have a potential of −290V, and hence the potential difference from the adjacent portions E3 is 130V, which is substantially equal to −150V which is obtained when the electrostatic image graduations 6*b* are not transferred.

Therefore, as illustrated in FIG. 14, the amount of change of an electric field which acts on the detecting portion 334*a* when the detecting portion 334*a* passes through the electrostatic image graduations 6*a* is substantially the same as that in the case where the electrostatic image graduations 6*b* are not transferred. Therefore, an output signal having a high SN ratio, which is substantially the same as a case where only the electrostatic image graduations 6*a* are transferred to the electrostatic image recording layer 14, is output.

In other words, since the potential of the portions E4 is lower than peripheral portions, the position detecting accuracy of induced current sensor 330 is improved. As described above, the induced current sensor 330 detects the induced current generated by the potential change of a measurement object and specifies the positions of the electrostatic image graduations 6*a* and 6*b*. Therefore, the larger the potential change of the electrostatic image graduations 6*a* and 6*b*, the larger the induced current, that is, the output signal detected by the induced current sensor 330 becomes, so that the sensitivity is improved. When the sensitivity is improved, an effect of certain electromagnetic noise on the detection error is reduced, so that the position detection accuracy is improved. The principle of detection of the potential distribution on the electrostatic image recording layer 14 by the induced current sensor 330 has been described thus far.

The DC voltages to be applied to the electrostatic image transfer rollers 15*a* and 15*b* when transferring the electrostatic image graduations 6*a* and 6*b* do not have to be the same. What is essential is that the DC voltage to be applied to the electrostatic image transfer rollers 15*a* and 15*b* is adjusted and the potential of the portions 4E are set arbitrarily. For example, assuming that the transfer voltage when transferring the electrostatic image graduations 6*a* is set to +1000V, and the transfer voltage when transferring the electrostatic image graduations 6*b* is set to +1160V. At this time, the transfer potential difference of the electrostatic image graduations 6*b* at the portions E4 of the electrostatic image graduations 6*a* corresponds to 1160V+(−160V)=+1000V.

As illustrated in FIG. 15, when the electrostatic image graduations 6*b* are transferred at a transfer potential difference of +1000V, a potential of −10V is added to the low-potential portions of the electrostatic image graduations 6*b* and a potential of −160V is added to the high-potential portions thereof. Since the potential of the high-potential portions of the electrostatic image graduations 6*a* is −160V, the potential of portions which correspond both to the high-potential portions of the electrostatic image graduations 6*a* and the low-potential portions of the electrostatic image graduations 6*b* is −160V+(−10V)=−170V. The potential of the portions which correspond both to the high-potential portions of the electrostatic image graduations 6*a* and the high-potential portions (=portions where the scales are overlapped) of the electrostatic image graduations 6*b* is −160V+(−160V)=−320V. Therefore, control of the potential of the portions E4 to −320V is achieved by setting the DC voltage to be applied to the electrostatic image transfer rollers 15*a* to +1000V and the DC voltage to be applied to the electrostatic image transfer rollers 15*b* to +1160V.

As illustrated in FIG. 17 with reference to FIG. 1, when correcting the color shift of the toner images in four color formed respectively at the image forming units 13*a*, 13*b*, 13*c*, and 13*d*, correction is preferably performed with reference to the electrostatic image graduations 6*a* transferred at the image forming unit 13*a*. As one of methods of correcting the color shift of the toner images in four colors at the electrostatic image recording layer 14 in one truck, the color shift correction of the image forming units 13*b*, 13*c* and 13*d* is executed in a time-division system in the first embodiment. The image forming unit 13*a* forms the electrostatic image graduations 6*a* and continuously transfers the electrostatic image graduations 6*a* to the electrostatic image recording layer 14. The image forming units 13*b*, 13*c* and 13*d* form the electrostatic image graduations 6*b*, 6*c*, and 6*d* in sequence by n number of times each, and transfer the electrostatic image graduations 6*b*, 6*c*, and 6*d* to the electrostatic image recording layers 14 so as to overlap with the electrostatic image graduations 6*a* in an intersecting manner.

The formation and the transfer of the electrostatic image graduations 6*c* and 6*d* at the image forming units 13*c* and 13*d* to the electrostatic image recording layers 14 are executed in the same manner as the formation of the electrostatic image graduations 6*b* and transfer to the electrostatic image recording layers 14 at the image forming unit 13*b*. Feedbacks to the exposure units 4*c* and 4*d* at the image forming units 13*c* and 13*d* on the basis of the result of detection of the belt scale detecting sensors 7 are executed in the same manner as the feedback to the exposure unit 4*b* on the basis of the result of detection of the belt scale detecting sensors 7.

A detection frequency of the color shift will be described. Where P is an average distance of the electrostatic image graduations 6*a* and the electrostatic image graduations 6*b*, 6*c*, and 6*d*, V is a speed of movement of the electrostatic image recording layers 14, and n is the number of times of repetition of formation of the electrostatic image graduations 6*b*, 6*c*, and 6*d*, a detection frequency f of the color shift is given by the following equation.

$$f = \frac{v}{3nP} \qquad \text{Eq. 2}$$

An average distance of the electrostatic image graduations 6*a* and the electrostatic image graduations 6*b* is assumed to be P=0.3387 mm, and the speed of movement of the electrostatic image recording layers 14 is assumed to be 300 mm/sec. When only the electrostatic image graduations 6*a* and the electrostatic image graduations 6*b* are formed continuously, the detection frequency f of the color shift is 300/0.3387=885.7 Hz.

When the number of times of repetition of formation of the electrostatic image graduations 6*b*, 6*c*, and 6*d* is n=1, the color shift detection is repeated in the order of the image forming unit 13*b*, the image forming unit 13*c*, the image forming unit 13*d*, the image forming unit 13*b* . . . , and so forth. Then, one color shift from a pair of the electrostatic image graduations 6*a* and the electrostatic image graduations

6*b* is calculated. In this case, the detection frequency f of the color shift corresponds to ⅓ of 885.7 Hz, that is, 885.7/3=295.2 Hz.

Assuming that the number of times of repetition of the formation of the electrostatic image graduations 6*b*, 6*c*, and 6*d* is n=2, if the amount of color shift is calculated by obtaining averages of two of the electrostatic image graduations 6*b*, 6*c*, and 6*d*, the detection frequency of the color shift is ½ of 295.2 Hz, that is, 295.2/2=147.6 Hz. When forming n sets of the electrostatic image graduations 6*b*, 6*c*, and 6*d* continuously (the number of times of repetition is n) and calculating the color shift of one of n sets by obtaining an average value of the n number of times, the detection frequency of the color shift is lowered. However, the error caused by high-frequency noise is averaged and reduced, so that the color shift can be detected with high degree of accuracy.

According to the color shift correction control of the first embodiment, since the electrostatic image graduations 6*b*, 6*c*, and 6*d* are transferred so as to overlap with the electrostatic image graduations 6*a* in an intersecting manner, the detection with a high SN ratio is achieved by the induced current sensor 330, so that the amount of color shift can be detected accurately. Since the detection frequency f of the color shift is improved, the highly responsive color shift correction is achieved. Since the space saving of the intermediate transfer belt 5 in the main scanning direction is achieved, the width of the intermediate transfer belt 5 may be reduced in design.

<Advantages of the First Embodiment>

As illustrated in FIG. 16A, in the first embodiment, the electrostatic image graduations 6*a* and the electrostatic image graduations 6*b* are formed so as to intersect each other at the same absolute value angle but in the opposite direction with respect to the width direction of the intermediate transfer belt 5 in order to detect the color shift in the sub scanning direction.

As illustrated in FIG. 16B, in the first embodiment, the induced current sensor 330 is configured to detect the electrostatic image graduations 6*a* by the Ch1 conducting wire 331*a* having the same inclination as the electrostatic image graduations 6*a*. The electrostatic image graduations 6*b*, 6*c*, and 6*d* are detected by the Ch2 conducting wire 331*b* having the same inclination as the electrostatic image graduations 6*b*, 6*c*, and 6*d*.

In the first embodiment, the electrostatic image graduations 6*a* to 6*d* formed at the image forming units 13*a*, 13*b*, 13*c*, and 13*d* have the same pitch. In the first embodiment, the color shift is read with high degree of accuracy without consuming toner meaninglessly by transferring the electrostatic image graduations 6*a* to 6*d* on the electrostatic image recording layers 14 in an overlapped manner and detecting the same.

In the first embodiment, since the time difference in detection of the position detecting marks of the respective colors may be short, accurate detection of the image shift is achieved without being affected easily by the variation in speed of the electrostatic image recording layers 14, the meandering movement of the intermediate transfer belt 5, or vibrations of the belt scale detecting sensors 7 themselves.

In the first embodiment, the color shift may be read with high degree of accuracy by transferring the electrostatic image graduations formed at the respective image forming units and specifically having the image information recorded therein on the electrostatic image recording layers 14 in an overlapped manner and detecting the same.

In the first embodiment, formation of the position detecting marks formed of toner image for detecting the color shift is not necessary. Even when the color shift is corrected frequently for reducing the color shift, much consumption of toner is avoided. Therefore, such an event that the cost is increased and hence the user cannot be satisfied in printing due to unexpected consumption of toner is avoided.

In the first embodiment, since the color shift in the direction of movement of the electrostatic image recording layers 14 (the sub scanning direction) and the color shift in the direction at a right angle (the main scanning direction) are detected substantially simultaneously, the color shift detection frequency is improved, and a down time (the time during which printing is not performed) is reduced. Since the time during which printing cannot be performed during the color shift correction, that is, a so-called down time (the time during which printing is not performed) may be shortened, the user is prevented from having unpleasant feeling.

In the first embodiment, even though the position detecting marks of the respective colors are overlapped with each other, the color that the position detecting mark belongs to can be recognized, and hence the position detecting marks for the respective colors may be arranged in an overlapped manner within a detecting range of one belt scale reading sensor. Since the position detecting marks for the respective colors may be arranged in an overlapped manner, the timing when the position detecting mark for the reference color of detection is detected and the timing when the position detecting mark for the target color is detected are close to each other. Since the timings when the position detecting marks for the respective colors are detected are close to each other, accurate detection of the image shift is achieved without being affected easily by the variation in speed of the electrostatic image recording layers 14, the meandering movement of the intermediate transfer belt 5, or vibrations of the belt scale reading sensors themselves. By overlapping the position detecting mark for the reference color with the position detecting marks for the non-reference colors simultaneously and detecting the same, detection of the color shift is achieved with high degree of accuracy without being affected easily by the variation in speed of the electrostatic image recording layers 14, the meandering movement of the intermediate transfer belt 5, or vibrations of the belt scale reading sensors themselves.

<Modification Example of First Embodiment>

In the first embodiment, two detecting units having a phase shift of 180° may be arranged in order to read the electrostatic image graduations with high degree of accuracy without being affected by foreign noise such as electromagnetic noise. In other words, when the electrostatic image graduations include 4 lines and 4 spaces, the two detecting units may be arranged 0.3387 mm÷180/360=0.1694 mm apart from each other. Accordingly, the signals with 180° phase shifting may be acquired. The foreign noise such as the electromagnetic noise to be superimposed on the output from the induced current sensor is cancelled by taking a differential between outputs from the two induced current sensors having a 180° phase difference from each other, and the signal strength is doubled. Therefore, the SN ratio is also doubled or even more, and the electrostatic image graduations may be detected with high degree of accuracy.

In the first embodiment, the two induced current sensors 330 having a phase shift of 90° may be provided in order to read the electrostatic image graduations at a high resolution. In other words, when the electrostatic image graduations include 4 lines and 4 spaces, the two induced current sensors 330 are arranged 0.3387 mm÷90/360=0.0847 mm apart from each other. By acquiring signals having a phase shift of 90° from the two induced current sensors 330, the electrostatic image graduations can be read at a high resolution. When the process speed (the surface speeds of the photosensitive drums and the intermediate transfer belt) is set to 300 mm/sec, and the electrostatic image graduation pitch is set to 0.3387 mm, a cycle of signals output from one of the induced current sensors 330 becomes 0.3387÷300=885.7 Hz. By detecting rising and dropping of the output voltages at timings when the output voltages from the two induced current sensors 330 become zero, a signal of 885.7×2=1771.5 Hz is acquired. Furthermore, when the two signals having a phase shift of 90° is detected, a signal of the electrostatic image graduations having a cycle of 1771.5 Hz×2=3543 Hz, when converted into a distance, 1/3543×300=0.0847 mm can be acquired.

Second Embodiment

Figure 18:
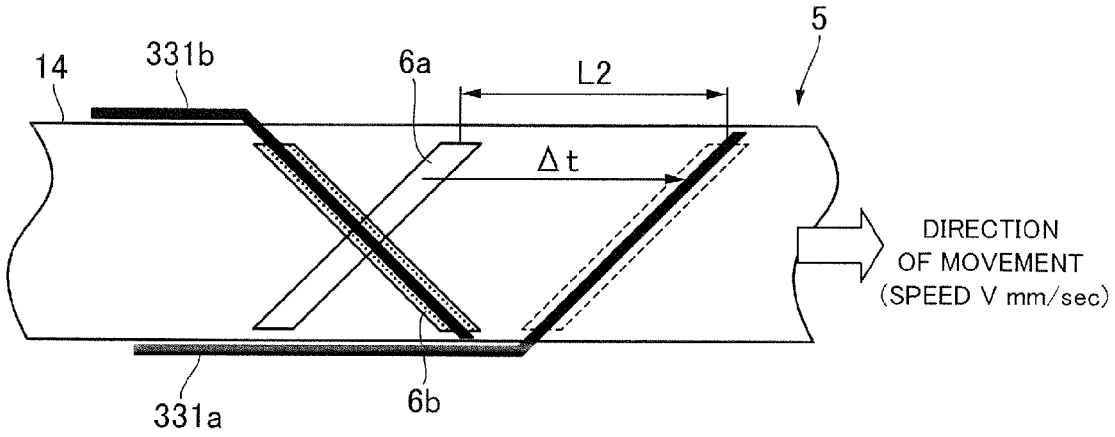
FIG. 18 is an explanatory drawing illustrating a delay time of detection of the electrostatic image graduation.
Figure 19:
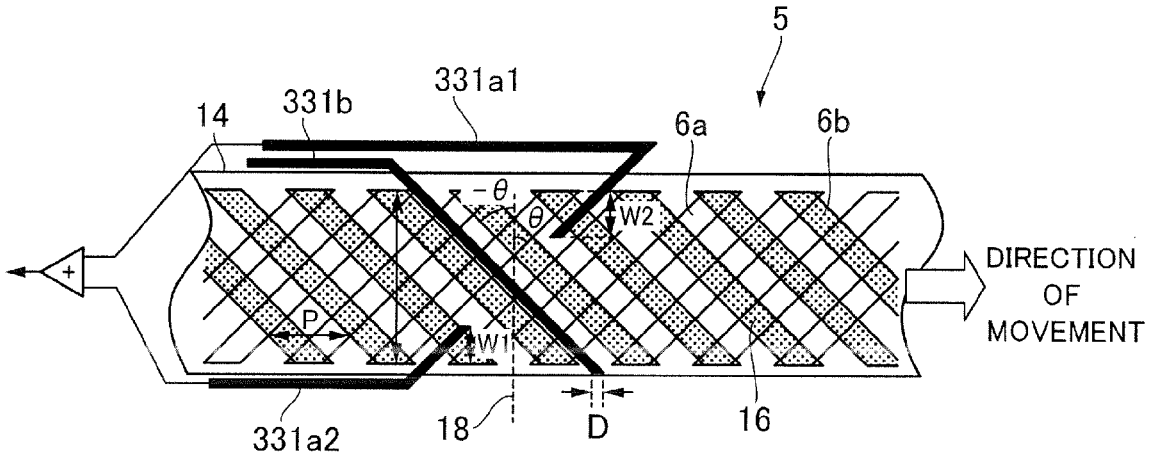
FIG. 19 is an explanatory drawing of a sensor arrangement for compensating the delay time of detection of the electrostatic image graduation.

FIG. 18 is an explanatory drawing illustrating a delay time of detection of the electrostatic image graduation. FIG. 19 is an explanatory drawing of a sensor arrangement for compensating the delay time of detection of the electrostatic latent image scale. As illustrated in FIG. 19, the conductive member of the Ch1 conducting wire 331*a* and the conductive member of the Ch2 conducting wire 331*b* are independent wiring patterns on the common sheet arranged so as to slide on the intermediate transfer belt 5. The conductor of the Ch1 conducting wire 331*a* and the conductor of the Ch2 conducting wire 331*b* are arranged so as to intersect on the common sheet.

As illustrated in FIG. 14, the induced current sensor 330 includes the Ch1 conducting wire 331*a* having the detecting portion 334*a* parallel to the electrostatic image graduations 6*a* and the Ch2 conducting wire 331*b* having the detecting portion 334*b* parallel to the electrostatic image graduations 6*b* formed on the common base film 332. FIG. 18 is a drawing extracted from FIG. 14 and illustrating a relationship between the Ch1 conducting wire 331*a*, the Ch2 conducting wire 331*b*, and the electrostatic image graduations 6*a* and 6*b*.

As illustrated in FIG. 18, when detecting the color shift in the sub scanning direction, the amount of positional shift between the electrostatic image graduations 6*a* and the electrostatic image graduations 6*b* located at the same position with respect to the direction of movement of the intermediate transfer belt 5 is preferably detected. However, since the Ch1 conducting wire 331*a* is arranged at a position L2 away from the Ch2 conducting wire 331*b*, a time difference of Δt occurs from a timing when the Ch2 conducting wire 331*b* detects the electrostatic image graduations 6*b* until a timing when the Ch1 conducting wire 331*a* detects the electrostatic image graduations 6*a*.

When the Ch1 conducting wire 331*a* and the Ch2 conducting wire 331*b* satisfy a relationship of the following equation (1), a minimum value of Δt is obtained from the following equation (3), where V is a speed of movement of the electrostatic image recording layers 14. The respective signs in the equation are as described above.

$$\frac{np}{2} = W \times \tan\theta \ (n \text{ is an integer}) \qquad \text{Eq. 1}$$

$$\Delta t = \frac{np}{V} \ (n \text{ is the same as "}n\text{" in Eq. 1}) \qquad \text{Eq. 3}$$

For example, in the case of P=0.3387 mm, n=12, and V=300 mm/sec, Δt=13.5 msec is satisfied. When the difference Δt between the timing when the Ch1 conducting wire 331*a* detects the electrostatic image graduations 6*a* and the timing when the Ch2 conducting wire 331*b* detects the electrostatic image graduations 6*b* is 13.5 msec, if the color shift is 0 and Δt is a value other than 13.5 msec, the color shift is generated in accordance with that amount.

However, actually, the time difference between the timing when the Ch1 conducting wire 331*a* detects the electrostatic image graduations 6*a* and the timing when the Ch2 conducting wire 331*b* detects the electrostatic image graduations 6*b* includes that caused by vibration of the induced current sensor 330 and by the amount of variation in speed of the electrostatic image recording layers 14 that occur during Δt. The amount of vibration of the induced current sensor 330 or the amount of variation in speed of the electrostatic image recording layers 14 is added to the actual shift between the electrostatic image graduations 6*a* and the electrostatic image graduations 6*b*.

In other words, the vibration of the induced current sensor 330 that occurs during Δt and the amount of variation in speed of the electrostatic image recording layers 14 appear as detection errors. Since the vibration and the variation in speed generally has a property that the amplitude is reduced with an increase in frequency, the detection error due to the vibration and the variation in speed is reduced by designing Δt to have a small value.

When converting Δt=13.5 msec into a frequency, 1/0.0135=74 Hz is satisfied. Therefore, in this case, result of detection is subject to vibrations of 74 Hz or more, or variation in speed. It is preferable to design the value of Δt, that is, the distance between the Ch1 conducting wire 331*a* and the Ch2 conducting wire 331*b* depending on the required detection accuracy.

In a second embodiment, the Ch1 conducting wire 331*a* and the Ch2 conducting wire 331*b* are arranged at positions intersecting each other at midpoints to set the time difference in detection Δt to zero. As illustrated in FIG. 19, since the distance between the midpoints of the oblique portions of the Ch1 conducting wire 331*a* and the Ch2 conducting wire 331*b* is substantially zero, the time difference in detection Δt is also zero. In the second embodiment, the Ch1 conducting wire 331*a* is divided into a Ch1 conducting wire 331*a*1 and a Ch1 conducting wire 331*a*2 so that the Ch1 conducting wire 331*a* and the Ch2 conducting wire 331*b* do not intersect each other. The Ch1 conducting wires 331*a*1 and 331*a*2 detect the same electrostatic image graduations 6*a* at the same time. In the second embodiment, output portions are provided on the Ch1 conducting wire 331*a*1 and the Ch1 conducting wire 331*a*2 respectively, and a sum of the output signals therefrom is used.

In this configuration, the electrostatic image graduations 6*a* and the electrostatic image graduations 6*b* located at the same position can be read at the substantially same timing by the Ch1 conducting wires 331*a*1 and 331*a*2 and the Ch2 conducting wire 331*b*, respectively. Consequently, the time difference in detection Δt between the Ch1 conducting wires 331*a*1 and 331*a*2 and the Ch2 conducting wire 331*b* is eliminated. Therefore, the shift amount between the electrostatic image graduations 6*a* and the electrostatic image graduations 6*b* can be detected with being little affected by the vibration of the induced current sensor 330 and the variation in speed of the electrostatic image recording layers 14.

When the Ch1 conducting wires 331*a*1 and 331*a*2 for reading the electrostatic image graduations 6*a* read the electrostatic image graduations 6*b*, a detection error results. A condition for preventing the Ch1 conducting wires 331*a*1 and 331*a*2 from reading the electrostatic image graduations 6*b* is that the Ch1 conducting wires 331*a*1 and 331*a*2 satisfy Equation (1), respectively. Therefore, where W1 and W2 are the lengths from an end of the electrostatic image graduations 6*b* to ends of the Ch1 conducting wire 331*a*2 and the Ch1 conducting wire 331$a$1, respectively, the condition for preventing the Ch1 conducting wires 331$a$1 and 331$a$2 from reading the electrostatic image graduations 6$b$ is defined by the following equation.

$$\frac{mp}{2} = (W1 + W2) \times \tan\theta \ (m \text{ is an integer}) \quad \text{Eq. 4}$$

Where D is a width of the Ch2 conducting wire 331$b$, the condition for insertion of the Ch2 conducting wire 331$b$ between the Ch1 conducting wires 331$a$1 and 331$a$2 is defined by the following equation.

$$\frac{W - (W1 + W2)}{\sin\theta} > \frac{D}{\cos\theta}\frac{mp}{2} \quad \text{Eq. 5}$$

From Equations (1), (3), and (4), the condition for m is defined by the following equation.

$$m < \frac{n - 2PD\tan^2\theta}{2} \quad \text{Eq. 6}$$

From Equation (6), a relation of m<5.98 is satisfied when P=0.3387 mm, θ=45°, n=12, and D=0.05 mm are satisfied. It is understood from Equation (4) that the value of W1 is increased with an increase of m, and the sensitivity of the Ch1 conducting wire 331$a$ is increased. Therefore, m=5 is preferable. At this time, from Equation (4) and Equation (1), if the relation of W1 and W2 is W1=W2, W1=W2=0.8468 mm, W=2.0322 mm are satisfied.

In the second embodiment, since the timing of detection of the position detecting marks of the respective colors are substantially the same, accurate detection of the image shift is achieved without being affected easily by the variation in speed of the electrostatic image recording layer 14, the meandering movement of the intermediate transfer belt 5, or vibrations of optical sensors themselves.

Third Embodiment

Figure 20:
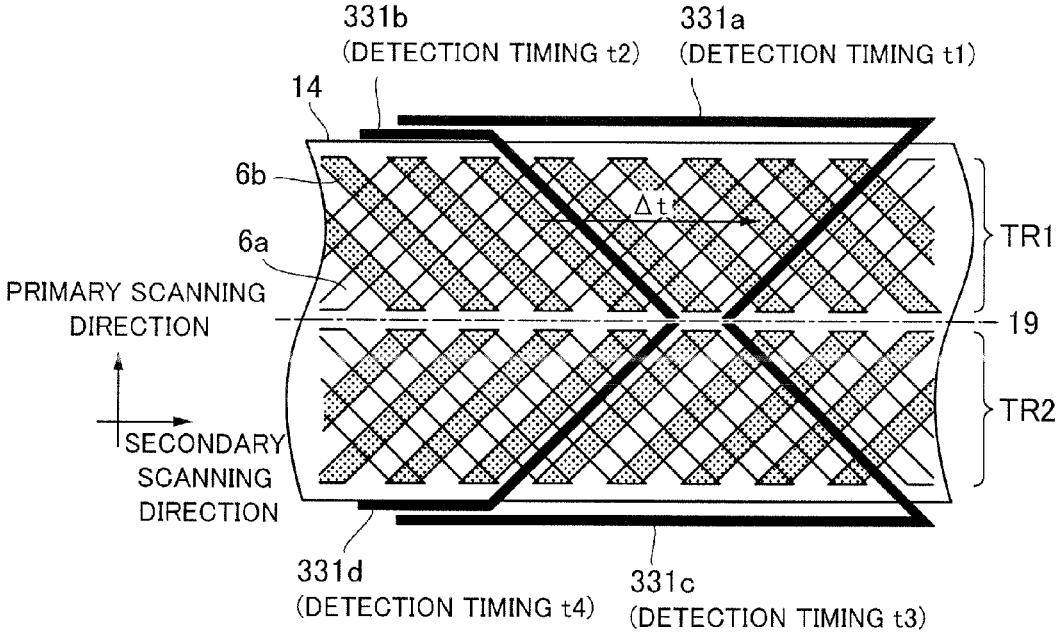
FIG. 20 is an explanatory drawing illustrating a configuration in which color shifts in a sub scanning direction and a main scanning direction are detected simultaneously.

FIG. 20 is an explanatory drawing illustrating a configuration in which the color shifts in the sub scanning direction and the main scanning direction are detected simultaneously. As illustrated in FIG. 20 with reference to FIG. 9, the exposure unit 4$a$ forms the electrostatic image graduations 6$c$, which is an example of a linear third electrostatic image index inclined by a third angle in the opposite direction to the first angle from the main scanning direction on the photosensitive drum 1$a$ in association with the formation of the electrostatic image graduations 6$a$. The exposure unit 4$b$ forms an electrostatic image graduations 6$d$, which are an example of a linear fourth electrostatic image index inclined by a fourth angle in the opposite direction to the second angle from the main scanning direction on the photosensitive drum 1$b$ in association with the formation of the electrostatic image graduations 6$b$.

A Ch3 conducting wires 331$c$ and a Ch4 conducting wire 331$d$ are arranged on the downstream of the photosensitive drum 1$b$ in the direction of movement of the intermediate transfer belt 5. The Ch3 conducting wire 331$c$, which is an example of a third detection portion, includes a detecting portion 334$c$, which is an example of a linear conductive member inclined by a third angle from the main scanning direction of the intermediate transfer belt 5, and detects an induced current of the electrostatic image graduations 6$c$ transferred to the intermediate transfer belt 5. The Ch4 conducting wire 331$d$, which is an example of a fourth detection portion, includes a detecting portion 334$d$, which is an example of a linear conductive member inclined by a fourth angle from the main scanning direction of the intermediate transfer belt 5, and detects an induced current of the electrostatic image graduations 6$d$ transferred to the intermediate transfer belt 5.

The control portion 17 transfers the electrostatic image graduations 6$a$, the electrostatic image graduations 6$b$, the electrostatic image graduations 6$c$, and the electrostatic image graduations 6$d$ to the intermediate transfer belt 5 at the time of non-image formation, and detects the same by the Ch1 conducting wire 331$a$, the Ch2 conducting wire 331$b$, the Ch3 conducting wires 331$c$, and the Ch4 conducting wire 331$d$. The control portion 17 adjusts the position of formation of the toner image on at least the photosensitive drum 1$a$ and the photosensitive drum 1$b$ in the main scanning direction and the sub scanning direction on the basis of the result of detection of the electrostatic image graduations 6$a$, the electrostatic image graduations 6$b$, the electrostatic image graduations 6$c$, and the electrostatic image graduations 6$d$.

As illustrated in FIG. 20, in order to detect the color shift in the sub scanning direction and in the main scanning direction, a track TR1 and a track TR2 are arranged on the electrostatic image recording layers 14 adjacently with a center line 19 positioned therebetween. An upper portion with respect to the center line 19 is defined as the track TR1, and a lower portion with respect to the center line 19 is defined as the track TR2.

The electrostatic image graduations 6$a$ and 6$b$ are formed on the track TR1 and the track TR2 respectively in an intersecting manner as illustrated in FIG. 14 so that the relationship of Equation (1) given above is satisfied. However, the electrostatic image graduations 6$a$ and 6$b$ of the track TR1 and the electrostatic image graduations 6$a$ and 6$b$ of the track TR2 are formed so as to be line symmetry with respect to the center line 19. In other words, the Ch1 conducting wire 331$a$ and the Ch3 conducting wire 331$c$ detect only the electrostatic image graduations 6$a$, and the Ch2 conducting wire 331$b$ and the Ch4 conducting wire 331$d$ detect only the electrostatic image graduations 6$b$.

In this manner, when the electrostatic image graduations 6$a$ and 6$b$ are arranged on the track TR1 and the track TR2, the positional shift in the sub scanning direction and the positional shift in the main scanning direction may be detected simultaneously. Timings when the Ch1 conducting wire 331$a$ and the Ch3 conducting wire 331$c$ detect the electrostatic image graduations 6$a$ are defined as t1 and t3 respectively. Timings when the Ch2 conducting wire 331$b$ and the Ch4 conducting wire 331$d$ detect the electrostatic image graduations 6$b$ are defined as t2 and t4 respectively.

At this time, the position of the electrostatic image graduations 6$a$ in the sub scanning direction is (t1+t3)/2, and the position of the electrostatic image graduations 6$b$ in the sub scanning direction is (t2+t4)/2. The position of the electrostatic image graduations 6$a$ in the main scanning direction is (t1−t3), and the position of the electrostatic image graduations 6$b$ in the main scanning direction is (t2−t4).

As described with reference to FIG. 18, there is a time difference of Δt from a timing when the Ch2 conducting wire 331$b$ and the Ch4 conducting wire 331$d$ detect the electrostatic image graduations 6$b$ until a timing when the Ch1 conducting wire 331$a$ and the Ch4 conducting wire 331$d$ detects the electrostatic image graduations 6$a$. Therefore, when the color shift in the sub scanning direction is expressed by the time difference Δt of detection, a relationship of the following equation is satisfied.

$$\left(\frac{t2+t4}{2}+\Delta t-\frac{t1+t3}{2}\right)\times V \quad \text{Eq. 7}$$

When the color shift in the main scanning direction by the time difference in detection, a relationship of the following equation is satisfied.

$$\{(t2-t4)-(t1-t3)\}\times V \quad \text{Eq. 8}$$

When Equation (7) and Equation (8) are multiplied by a speed of movement V of the electrostatic image recording layers 14, the amounts of color shift in the sub scanning direction and the main scanning direction are calculated.

In the third embodiment, since the color shift in the direction of movement of the electrostatic image recording layers 14 (the sub scanning direction) and the color shift in the direction at a right angle (the main scanning direction) are detected substantially simultaneously in a saved space, the color shift detection frequency is improved, and a down time (the time during which printing is not performed) is reduced. In the third embodiment, different patterns need not to be formed for detecting the color shift in the sub scanning direction and the color shift in the main scanning direction. The shift amounts of the color shift detection patterns in the sub scanning direction and the main scanning direction do not have to be changed continuously in the sub scanning direction. Therefore, the length of the color shift detection pattern in the sub scanning direction may be short, and the detection frequency of the color shift may be increased.

Fourth Embodiment

Figure 21:
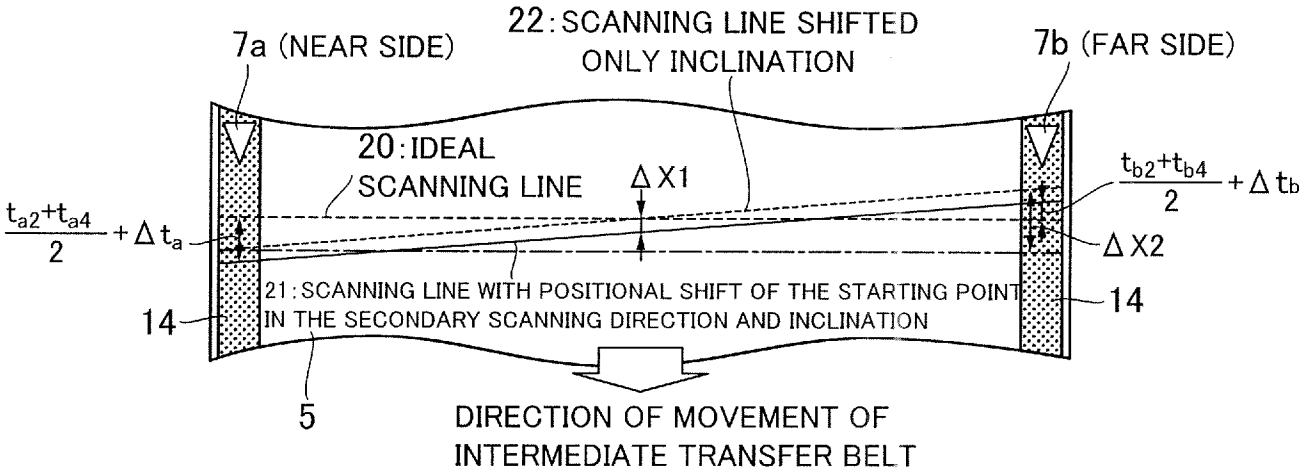
FIG. 21 is an explanatory drawing of a sort of the color shift in the sub scanning direction.
Figure 22:
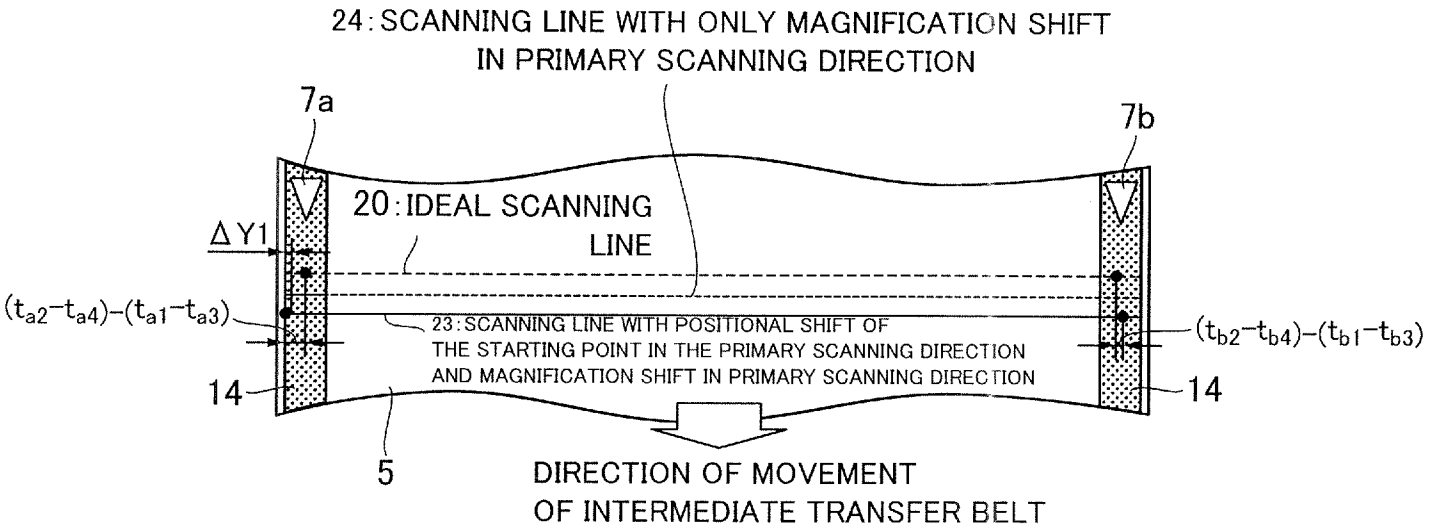
FIG. 22 is an explanatory drawing of a sort of the color shift in the main scanning direction.

FIG. 21 is an explanatory drawing of a sort of the color shift in the sub scanning direction. FIG. 22 is an explanatory drawing of a sort of the color shift in the main scanning direction. As illustrated in FIG. 21, the electrostatic image graduations 6*a*, the electrostatic image graduations 6*b*, the electrostatic image graduations 6*c*, and the electrostatic image graduations 6*d* are transferred respectively to one end portion and the other end portion of the intermediate transfer belt 5 in the main scanning direction. The Ch1 conducting wire 331*a*, the Ch2 conducting wire 331*b*, the Ch3 conducting wire 331*c*, and the Ch4 conducting wire 331*d* are arranged respectively on one end portion and the other end portion of the intermediate transfer belt 5 in the main scanning direction. As illustrated in FIG. 22, the control portion 17 adjusts the magnification shift of the primary scanning and the inclination of the main scanning direction of the toner image on at least the photosensitive drum 1*a* and the photosensitive drum 1*b* in the main scanning direction and the sub scanning direction on the basis of the result of detection of the electrostatic image graduations 6*a*, the electrostatic image graduations 6*b*, the electrostatic image graduations 6*c*, and the electrostatic image graduations 6*d*.

As illustrated in FIG. 1, the image forming apparatus 100 has the same configuration in respective cross section in the depth direction. Scanning lines formed by the exposure units 4*a* and 4*b* on the photosensitive drums 1*a* and 1*b* are visualized by the developing units 8*a* and 8*b*, and are transferred to the intermediate transfer belt 5, so as to be observed linearly on the intermediate transfer belt 5 as illustrated in FIG. 21 and FIG. 22.

As illustrated in FIG. 21, the color shift in the sub scanning direction is broken down into a positional shift of a starting point in the sub scanning direction and the inclination shift in the main scanning direction. The positional shift of the starting point in the sub scanning direction corresponds to a state in which an average position of the scanning lines in the sub scanning direction is shifted from an ideal position of the scanning line 20 in the sub scanning direction. The value of the positional shift of the starting point in the sub scanning direction corresponds to ΔX1 in FIG. 21. In contrast, the inclination shift in the main scanning direction corresponds to a state in which the position of the scanning lines in the sub scanning direction change linearly in accordance with the position in the primary scanning and the value corresponds to ΔX2 in FIG. 21. The actual scanning line is as indicated by a scanning line 21 since it includes both the positional shift of the starting point in the sub scanning direction and the inclination shift mixed thereto.

As illustrated in FIG. 20, in the fourth embodiment, the track TR1 and the track TR2 are arranged respectively on both ends of the intermediate transfer belt 5 in the width direction.

As illustrated in FIG. 21, the belt scale detecting sensor 7*a* configured to sense the track TR1 includes the Ch1 conducting wire 331*a* to the Ch4 conducting wire 331*d* arranged therein as illustrated in FIG. 20. Detection timings of the Ch1 conducting wire 331*a* to the Ch4 conducting wire 331*d* of the belt scale detecting sensor 7*a* are defined as ta1, ta2, ta3, and ta4, respectively, in this order.

As illustrated in FIG. 21, the belt scale detecting sensor 7*b* configured to sense the track TR2 includes the Ch1 conducting wire 331*a* to the Ch4 conducting wire 331*d* arranged therein as illustrated in FIG. 20. Detection timings of the Ch1 conducting wire 331*a* to the Ch4 conducting wire 331*d* of the belt scale detecting sensor 7*b* are defined as tb1, tb2, tb3, and tb4, respectively, in this order.

At this time, ΔX1 which corresponds to the positional shift of the starting point in the sub scanning direction or ΔX2 which corresponds to the inclination shift is given by the following equation.

$$\Delta X1=\left[\left\{\left(\frac{t_{a2}+t_{a4}}{2}+\Delta t_a-\frac{t_{a1}+t_{a3}}{2}\right)+\left(\frac{t_{b2}+t_{b4}}{2}+\Delta t_b-\frac{t_{b1}+t_{b3}}{2}\right)\right\}\div 2\right]\times V \quad \text{Eq. 9}$$

$$\Delta X2=\left\{\left(\frac{t_{a2}+t_{a4}}{2}+\Delta t_a-\frac{t_{a1}+t_{a3}}{2}\right)-\left(\frac{t_{b2}+t_{b4}}{2}+\Delta t_b-\frac{t_{b1}+t_{b3}}{2}\right)\right\}\times V \quad \text{Eq. 10}$$

As illustrated in FIG. 22, the color shift in the main scanning direction is broken down into a positional shift of starting point in the main scanning direction and a magnification shift in the main scanning direction. The positional shift of the starting point in the main scanning direction corresponds to a state in which an average position of the scanning lines in the main scanning direction corresponds to a distance of shift from the ideal average position of the scanning line 20 in the main scanning direction. The amount of the positional shift of the starting point in the main scanning direction corresponds to ΔY1 in FIG. 22. In contrast, the magnification shift in the main scanning direction is defined by a difference between the entire length of the scanning line in the main scanning direction and the entire length of the ideal scanning line 20. The value ΔY2 of the magnification shift in the main scanning direction is defined as (length of the actual scanning line 23)-(length of the ideal scanning line 20).

ΔY1 which corresponds to the positional shift of the starting point in the main scanning direction or ΔY2 which corresponds to the magnification shift in the main scanning direction is given by the following equation.

$$\Delta Y1=[\{((t_{a2}-t_{a4})-(t_{a1}-t_{a3}))+(t_{b2}-t_{b4})-(t_{b1}-t_{b3}))\}\pm 2]\times V \quad \text{Eq. 11}$$

$$\Delta Y2=[\{(t_{a2}-t_{a4})-(t_{a1}-t_{a3})\}-\{(t_{b2}-t_{b4})-(t_{b1}-t_{b3})\}]\times X \quad \text{Eq. 12}$$

When the description given above is summarized, arithmetic equations in Table 1 may be used for detecting the color shift by breaking down into types.

TABLE 1

| COLOR SHIFT BREAK-DOWN | |
|---|---|
| COLOR SHIFT BREAK-DOWN | ARITHMETIC EQUATION FOR CALCULATING SHIFT AMOUNT |
| POSITIONAL SHIFT OF THE STARTING POINT IN THE SUB SCANNING DIRECTION ΔX1 | $\left[\left\{\left(\frac{t_{a2}+t_{a4}}{2}+\Delta t_a-\frac{t_{a1}+t_{a3}}{2}\right)+\left(\frac{t_{b2}+t_{b4}}{2}+\Delta t_b-\frac{t_{b1}+t_{b3}}{2}\right)\right\}\div 2\right]\times V$ |
| INCLINATION SHIFT ΔX2 | $\left\{\left(\frac{t_{a2}+t_{a4}}{2}+\Delta t_a-\frac{t_{a1}+t_{a3}}{2}\right)-\left(\frac{t_{b2}+t_{b4}}{2}+\Delta t_b-\frac{t_{b1}+t_{b3}}{2}\right)\right\}\times V$ |
| POSITIONAL SHIFT OF THE STARTING POINT IN THE MAIN SCANNING DIRECTION ΔY1 | $[\{((t_{a2}-t_{a4})-(t_{a1}-t_{a3}))+((t_{b2}-t_{b4})-(t_{b1}-t_{b3}))\}\div 2]\times V$ |
| MAGNIFICATION SHIFT IN THE MAIN SCANNING DIRECTION ΔY2 | $[\{(t_{a2}-t_{a4})-(t_{a1}-t_{a3})\}-\{(t_{b2}-t_{b4})-(t_{b1}-t_{b3})\}]\times V$ |

In the fourth embodiment, different patterns need not to be formed for detecting the color shift in the sub scanning direction and the color shift in the main scanning direction. The shift amounts of the color shift detection patterns in the sub scanning direction and the main scanning direction do not have to be changed continuously in the sub scanning direction, and hence the length of the pattern in the sub scanning direction may be short. From these reasons, the detection frequency of the color shift may be increased.

Fifth Embodiment

Figure 23:
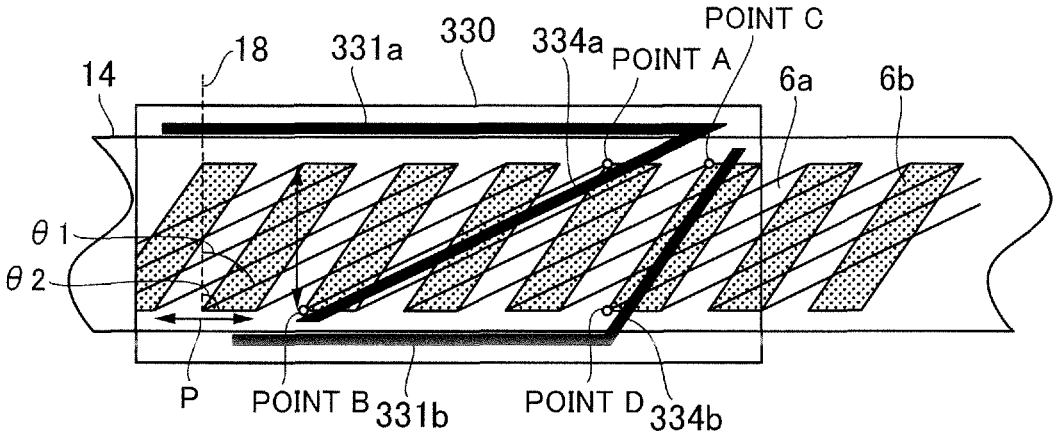
FIG. 23 is an explanatory drawing of a detection principle of an electrostatic image graduation of a fifth embodiment.
Figure 24:
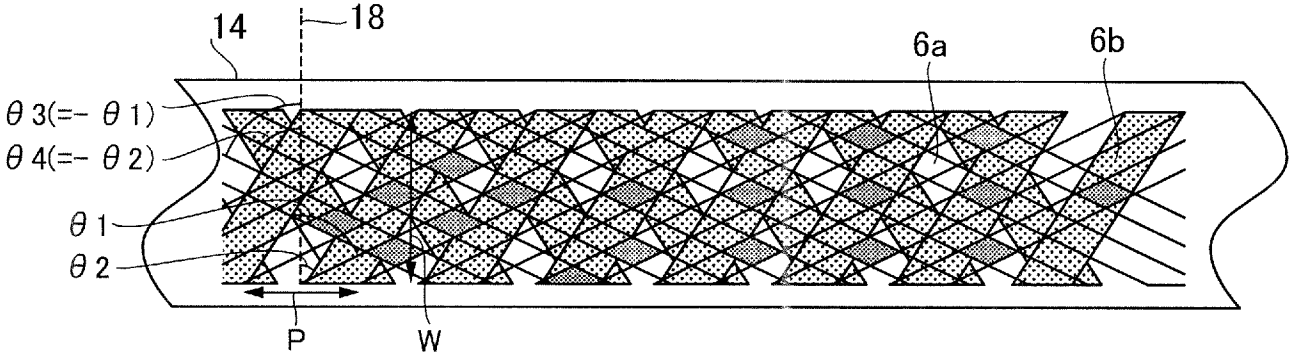
FIG. 24 is an explanatory drawing of an arrangement of the electrostatic image graduation at four angles of inclination in an electrostatic image recording layer.
Figure 25:
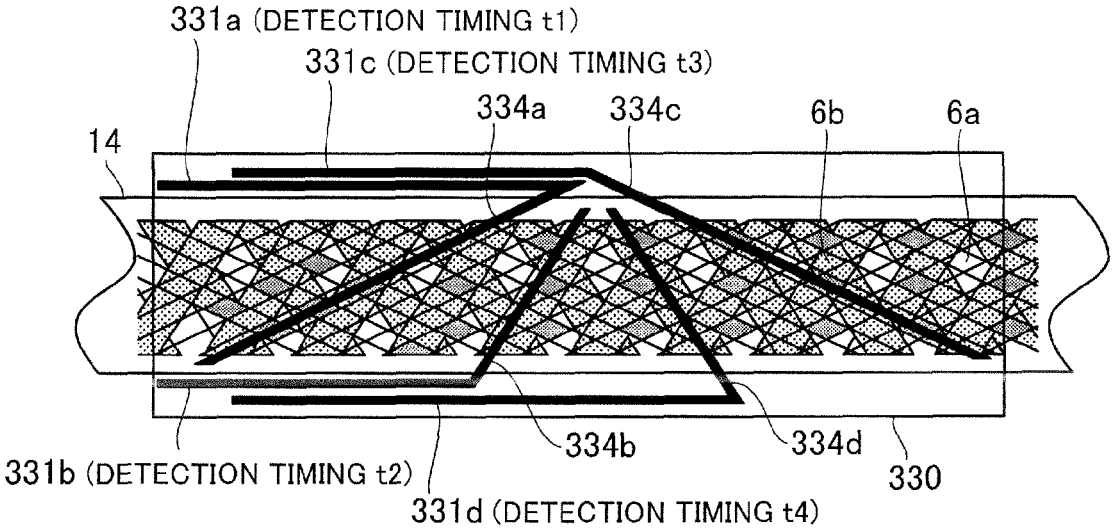
FIG. 25 is an explanatory drawing illustrating an arrangement of detecting portions at the four angles of inclination.

FIG. 23 is an explanatory drawing of a detection principle of the electrostatic image graduation of a fifth embodiment. FIG. 24 is an explanatory drawing of an arrangement of the electrostatic image graduations at four angles of inclination. FIG. 25 is an explanatory drawing illustrating an arrangement of the detected portions at four angles of inclination. As illustrated in FIG. 20, in the third embodiment, in order to detect the color shift in the sub scanning direction and in the main scanning direction simultaneously, a track TR1 and a track TR2 are used. In the third embodiment, the electrostatic image graduations 6*a* and the electrostatic image graduations 6*b* formed on the tracks TR1 and TR2 are inclined with respect to the width direction of the intermediate transfer belt 5 in the opposite direction, and have the same absolute value. The electrostatic image graduations 6*c* formed on the track TR2 have the same inclination as the electrostatic image graduations 6*a* formed on the track TR1, and the electrostatic image graduations 6*d* formed on the track TR2 have the same inclination as the electrostatic image graduations 6*b* formed on the track TR1.

Assuming that the electrostatic image graduations 6*a* having two angles of inclination and the electrostatic image graduations 6*b* having two angles of inclination as illustrated FIG. 20 are formed on one track, the electrostatic image graduations having the same angle of inclination need to be formed at different positions in the sub scanning direction. Signals of the electrostatic image graduations 6*a* and 6*b* detected by the Ch1 conducting wire 331*a* and signals of the electrostatic image graduations 6*a* and 6*b* detected by the Ch2 conducting wire 331*b* needs to be separated with software. Therefore, basically, the four types of electrostatic image graduations 6*a* and 6*b* having two different angles of inclination cannot be formed in an overlapped manner on one track.

In the fifth embodiment, necessity of separation of the signals by using software for detecting the color shifts in the sub scanning direction and the main scanning direction on one track is eliminated by forming the electrostatic image graduations 6*a* and 6*b* at four different angles. Since the configurations in the fifth embodiment are the same as those described in the first embodiment except for the angles of inclination of the electrostatic image graduations 6*a* and 6*b* and the angles of inclination of the Ch1 conducting wire 331*a* and the Ch2 conducting wire 331*b*, the configuration in FIG. 18 and FIG. 19 common to those in the first embodiment, the same reference numerals as in FIG. 11 to FIG. 16 are denoted, and overlapped description will be omitted.

In the fifth embodiment, four types of the electrostatic image graduations 6*a* and 6*b* are arranged in an overlapped manner by arranging the electrostatic image graduations 6*a* and 6*b* on the electrostatic image recording layers 14 at two different angles of inclination having different absolute values, so that detection of the color shift in the sub scanning direction is achieved.

As illustrated in FIG. 23, in the image forming unit 13*a*, the electrostatic image graduations 6*a* are formed on the electrostatic image recording layers 14 of the intermediate transfer belt 5 so as to incline with respect to a line 18 in the belt width direction by an angle of θ1 and the electrostatic image graduations 6*b* are formed so as to incline with respect to the line 18 in the belt width direction by an angle of θ2 at the image forming unit 13*a*. The electrostatic image graduations 6*a* on the electrostatic image recording layers 14 are detected independently by the Ch1 conducting wire 331*a* inclined with respect to the line 18 in the belt width direction by the angle of θ1, and the electrostatic image graduations 6*b* are detected independently by the Ch2 conducting wire 331*b* inclined with respect to the line 18 in the belt width direction by the angle of θ2.

As illustrated in FIG. 24, the electrostatic image graduations 6*c* and 6*d* are transferred onto the electrostatic image recording layers 14 on which the electrostatic image graduations 6*a* and 6*b* are formed at the image forming unit 13*b* so as to be partly overlapped. The electrostatic image graduations 6*c* are formed so as to incline with respect to the line 18 in the belt width direction by an angle of −θ1 and the electrostatic image graduations 6*d* are formed on the electrostatic image recording layers 14 of the intermediate transfer belt 5 so as to incline with respect to the line 18 in the belt width direction by an angle of −θ2. The electrostatic image graduations 6*c* on the electrostatic image recording layers 14 is detected independently by the Ch3 conducting wire 331*c* inclined with respect to the line 18 in the belt width direction by an angle of −θ1, and the electrostatic image graduations 6*d* are detected independently by the Ch4 conducting wire 331*d* inclined with respect to the line 18 in the belt width direction by an angle of −θ2. Four types of the electrostatic image graduations having different angles of inclination of ±θ1 and ±θ2 are formed on the electrostatic image recording layers 14 of the intermediate transfer belt 5 that has passed through the image forming unit 13*b*, and the angles of inclination of ±θ1 and ±θ2 are detected independently by the four different types of conducting wires.

As illustrated in FIG. 23, the shape of the electrostatic image graduations 6*a* is parallelogram including two sides parallel to the direction of movement of the electrostatic image recording layers 14 at two longitudinal ends. The shape of the electrostatic image graduations 6*b* are parallel to the direction of movement of the electrostatic image recording layers 14 at two longitudinal ends. In the fifth embodiment as well, the electrostatic image graduations 6*a* and 6*b* have the same pitch (dimension P) and the same width (dimension W).

The induced current sensor 330 includes the Ch1 conducting wire 331*a* having the detecting portion 334*a* parallel to the electrostatic image graduations 6*a* and the Ch2 conducting wire 331*b* having the detecting portion 334*b* parallel to the electrostatic image graduations 6*b*. At this time, if the induced current generated by the electrostatic image graduations 6*b* is mixed to the detected signal of the Ch1 conducting wire 331*a*, the induced current works as noise for the Ch1 conducting wire 331*a*, so that the position of the electrostatic image graduations 6*a* cannot be detected accurately any longer. The same applies to the Ch2 conducting wire 331*b*. In other words, it is necessary that the Ch1 conducting wire 331*a* does not detect the electrostatic image graduations 6*b*, and the Ch2 conducting wire 331*b* does not detect the electrostatic image graduations 6*a*, respectively.

First of all, conditions that the Ch2 conducting wire 331*b* does not detect the electrostatic image graduations 6*a* will be described. The longitudinal direction of the detecting portion 334*b* of the Ch2 conducting wire 331*b* is the longitudinal direction of the electrostatic image graduations 6*a*, and the length of the Ch2 conducting wire 331*b* is longer than the length of the electrostatic image graduations 6*a*. The electrostatic image graduations 6*b* determines the width W, the angle θ, and the pitch P of the electrostatic image graduations 6*a* and 6*b* so that the electrostatic image graduations 6*b* connect acute angle apexes (points A in FIG. 23) at one of the ends of the respective marks of the electrostatic image graduations 6*a* and obtuse angle apexes (points B in FIG. 23) at the other ends thereof. In this configuration, even though the electrostatic image graduations 6*a* are moved, the surface area of the electrostatic image graduations 6*a* immediately below the detecting portion 334*b* of the Ch2 conducting wire 331*b* is constant, and hence an induced current caused by the electrostatic image graduations 6*a* is not generated in the Ch2 conducting wire 331*b*. In other words, the Ch2 conducting wire 331*b* does not detect the electrostatic image graduations 6*a*. The conditional equation at this time is defined as the following equation. In the following equation, θ1, θ2, θ3, and θ4 are expressed as $\theta_1$, $\theta_2$, $\theta_3$, and $\theta_4$ respectively for easy recognition of the equation.

$$\frac{lP}{W} = \tan\theta_1 - \tan\theta_2 \ (l \text{ is an integer}) \qquad \text{Eq. 13}$$

For example, W=7×0.3387 mm/(tan 60°−tan 30°)=2.0533 mm, where P=0.3387 mm, θ1=60°, θ2=30°, and 1=7. The conditions of the following equation (13) are also conditions for prevention of detection of the electrostatic image graduations 6*b* by the Ch1 conducting wire 331*a*.

As illustrated in FIG. 24, the electrostatic image graduations 6*a*, the electrostatic image graduations 6*b*, the electrostatic image graduations 6*c*, and the electrostatic image graduations 6*d* are transferred respectively to the intermediate transfer belt 5, which is an example of the conveying member in overlapped manner at different angles of inclination with respect to the main scanning direction. As illustrated in FIG. 24, in order to detect the color shift in the sub scanning direction and the main scanning direction of the image forming unit (13*b*, FIG. 1), the electrostatic image graduations 6*c* and the electrostatic image graduations 6*d* each have linear portions at two angles. The electrostatic image graduations 6*a* and 6*c* are composed of lines having the angles of θ1 and θ3 with respect to the line 18 in the belt width direction, and the electrostatic image graduations 6*b* and 6*d* are composed of lines having the angles of θ2 and θ4.

As illustrated in FIG. 25, the Ch1 to Ch4 conducting wires 331*a*, 331*b*, 331*c*, and 331*d* having components parallel respectively to the formed electrostatic image graduations 6*a*, 6*b*, 6*c*, and 6*d* are arranged to detect the respective electrostatic image graduations 6*a*, 6*b*, 6*c*, and 6*d*.

Here as well, the Ch1 to Ch4 conducting wires 331*a*, 331*b*, 331*c*, and 331*d* need to be prevented from detecting the scales other than the electrostatic image graduations 6*a*, 6*b*, 6*c*, and 6*d* parallel thereto respectively. The conditions are as follows. Hereinafter, the electrostatic image graduations formed at the angle of θ1 with respect to the line 18 in the belt width direction is referred to as θ1 scales. The same applies to the angles of θ2 to θ4. The condition for prevention of the Ch1 conducting wire 331*a* from detecting scales other than the θ1 scales is that the θ2 scales to the θ4 scales satisfy the equation (13) with respect to the θ1 scale. In other words, the conditions at this time is given by the following three equations.

$$\frac{lP}{W} = \tan\theta_1 - \tan\theta_2 (l \text{ is an integer}) \qquad \text{Eq. 13}$$

$$\frac{mP}{W} = \tan\theta_1 - \tan\theta_3 (m \text{ is an integer}) \qquad \text{Eq. 14}$$

$$\frac{nP}{W} - \tan\theta_1 - \tan\theta_4 (n \text{ is an integer}) \qquad \text{Eq. 15}$$

Equation (13) to Equation (15) indicate that if a tangential difference between the two angles becomes a whole-number multiple of P/W (=non-interference condition), it indicates that the two conducting wires parallel to the two electrostatic image graduations can be detected without interference of signals. The fact that the θ2 scales, the θ3 scales and the θ4 scales satisfy the non-interference conditions when the electrostatic image graduations are formed so as to satisfy the conditions of Equation (13) to Equation (15) will be proved.

$$\tan\theta_2 - \tan\theta_3 = \tan\theta_2 - \left(\tan\theta_1 - \frac{mP}{W}\right) = (\tan\theta_2 - \tan\theta_1) + \frac{mP}{W} = -\frac{lp}{W} + \frac{mP}{W} = \frac{(-l+m)P}{W} \quad \text{Eq. 16}$$

$$\tan\theta_2 - \tan\theta_4 = \ldots = \frac{(-l+n)P}{W} \quad \text{Eq. 17}$$

From Equation (13), Equation (16), and Equation (17), the θ2 scales satisfy the non-interference condition with respect to other electrostatic image graduations, the Ch2 conducting wire 331*b* parallel to the θ2 scales does not detect scales other than the θ2 scales.

The fact that the θ3 scales and the θ4 scales satisfy the non-interference conditions will be proved.

$$\tan\theta_3 - \tan\theta_4 = \left(\tan\theta_1 - \frac{mP}{W}\right) - \left(\tan\theta_1 - \frac{nP}{W}\right) = \frac{(-m+n)P}{W} \quad \text{Eq. 18}$$

Therefore, the θ3 scales and the θ4 scales satisfy the non-interference condition. Therefore, it is proved that the Ch3 conducting wire 331*c* does not detect the scales other than the θ3 scales, and the Ch4 conducting wire 331*d* does not detect the scales other than the θ4 scales.

From the description given above, by forming the θ1 to the θ4 scales so as to satisfy the conditions of Equation (13) to Equation (15), and arranging the conducting wires parallel to the θ1 to the θ4 scales respectively, only the electrostatic image graduations that are parallel to the respective conducting wires may be detected without the interference of the respective signals. Therefore, according to the fifth embodiment, the signals do not have to be separated by displacing the positions of the electrostatic image graduations as illustrated in FIG. 17, and the color shift in the sub scanning direction and the main scanning direction can be detected on one track.

Sixth Embodiment

In the sixth embodiment, the electrostatic image graduations 6*a*, 6*b*, 6*c*, and 6*d* of the fifth embodiment are arranged at both end portions of the intermediate transfer belt 5 in the width direction, and breaking down of the color shifts is performed as in the fourth embodiment.

As illustrated in FIG. 25, breaking down of the color shifts is enabled with simple arithmetic equations by arranging the Ch2 conducting wire 331*b* and the Ch4 conducting wire 331*d* configured to detect the electrostatic image graduations 6*b* and 6*d* between the Ch1 conducting wire 331*a* and the Ch3 conducting wire 331*c* configured to detect the electrostatic image graduations 6*a* and 6*c*.

Here, in order to simplify the color shift, the equations θ3=−θ1, θ4=−θ2 are assumed. The moments when the Ch1 conducting wire 331*a* and the Ch3 conducting wire 331*c* detect the electrostatic image graduations 6*a* and 6*c* are defined as t1 and t3, respectively, and the moment when the Ch2 conducting wire 331*b* and the Ch4 conducting wire 331*d* detect the electrostatic image graduations 6*b* and 6*d* are defined as T2 and t4, respectively. At this time, the color shift in the sub scanning direction and the color shift in the main scanning direction are given by the following equations.

$$\left(\frac{t2+t4}{2} - \frac{t1+t3}{2}\right) \times V \quad \text{Eq. 19}$$

$$\{(t2-t4)-(t1-t3)\} \times V \quad \text{Eq. 20}$$

As described in the fourth embodiment with reference to FIG. 21 and FIG. 22, the color shift in the sub scanning direction is mainly broken down into the positional shift of the starting point in the sub scanning direction and the inclination shift, and the color shift in the main scanning direction is mainly broken down into the positional shift of the starting point in the main scanning direction and the magnification shift in the main scanning direction.

In the sixth embodiment as well, as illustrated in FIG. 21 and FIG. 22, the belt scale detecting sensors 7*a* and 7*b* are arranged at both end portions of the intermediate transfer belt 5 in the width direction. At this time, detection timings of the Ch1 conducting wire 331*a* to the Ch4 conducting wire 331*d* of the belt scale detecting sensor 7*a* are defined as ta1, ta2, ta3, and ta4, respectively, in this order. Detection timings of the Ch1 conducting wire 331*a* to the Ch4 conducting wire 331*d* of the belt scale detecting sensor 7*b* are defined as tb1, tb2, tb3, and tb4, respectively, in this order. At this time, ΔX1 which corresponds to the positional shift of the starting point in the sub scanning direction or ΔX2 which corresponds to the shift of inclination is given by the following equation.

$$\Delta X1 = \left[\left\{\left(\frac{t_{a2}+t_{a4}}{2} - \frac{t_{a1}+t_{a3}}{2}\right) + \left(\frac{t_{b2}+t_{b4}}{2} - \frac{t_{b1}+t_{b3}}{2}\right)\right\} \div 2\right] \times V \quad \text{Eq. 21}$$

$$\Delta X2 = \left\{\left(\frac{t_{a2}+t_{a4}}{2} - \frac{t_{a1}+t_{a3}}{2}\right) - \left(\frac{t_{b2}+t_{b4}}{2} - \frac{t_{b1}+t_{b3}}{2}\right)\right\} \times V \quad \text{Eq. 22}$$

Also, ΔY1 which corresponds to the positional shift of the starting point in the main scanning direction or ΔY2 which corresponds to the magnification shift in the main scanning direction is given by the following equation.

$$\Delta Y1 = [\{((t_{a2}-t_{a4})-(t_{a1}-t_{a3})) + ((t_{b2}-t_{b4})-(t_{b1}-t_{b3}))\} \div 2] \times V \quad \text{Eq. 23}$$

$$\Delta Y2 = [\{(t_{a2}-t_{a4})-(t_{a1}-t_{a3})\} - \{(t_{b2}-t_{b4})-(t_{b1}-t_{b3})\}] \times V \quad \text{Eq. 24}$$

When the description given above is summarized, arithmetic equations in Table 2 may be used for detecting the color shift by breaking down into types.

TABLE 2

| COLOR SHIFT BREAK-DOWN | |
|---|---|
| COLOR SHIFT BREAK-DOWN | ARITHMETIC EQUATION FOR CALCULATING SHIFT AMOUNT |
| POSITIONAL SHIFT OF THE STARTING POINT IN THE SUB SCANNING DIRECTION ΔX1 | $\left[\left\{\left(\frac{t_{a2}+t_{a4}}{2}-\frac{t_{a1}+t_{a3}}{2}\right)+\left(\frac{t_{b2}+t_{b4}}{2}-\frac{t_{b1}+t_{b3}}{2}\right)\right\}\div 2\right]\times V$ |
| INCLINATION SHIFT ΔX2 | $\left\{\left(\frac{t_{a2}+t_{a4}}{2}-\frac{t_{a1}+t_{a3}}{2}\right)-\left(\frac{t_{b2}+t_{b4}}{2}-\frac{t_{b1}+t_{b3}}{2}\right)\right\}\times V$ |
| POSITIONAL SHIFT OF THE STARTING POINT IN THE MAIN SCANNING DIRECTION ΔY1 | $[\{((_{ta2}-t_{a4})-(t_{a1}-t_{a3}))+((t_{b2}-t_{b4})-(t_{b1}-t_{b3}))\}\div 2]\times V$ |
| MAGNIFICATION SHIFT IN THE MAIN SCANNING DIRECTION ΔY2 | $[\{(t_{a2}-t_{a4})-(t_{a1}-t_{a3})\}-\{(t_{b2}-t_{b4})-(t_{b1}-t_{b3})\}]\times V$ |

Seventh Embodiment

FIG. 26 is an explanatory drawing of a detection principle of the electrostatic image graduation of a seventh embodiment. FIG. 27 is an explanatory drawing illustrating an arrangement of the electrostatic image graduation and belt scale detecting sensors in the seventh embodiment. As illustrated in FIG. 27, the electrostatic image graduations 6*a*, the electrostatic image graduations 6*b*, the electrostatic image graduations 6*c*, and the electrostatic image graduations 6*d* are transferred to the intermediate transfer belt 5 in an overlapped manner. Two each of the electrostatic image graduations 6*a*, the electrostatic image graduations 6*b*, the electrostatic image graduations 6*c*, and the electrostatic image graduations 6*d* have the same angle of inclination with respect to the main scanning direction and the pitches have relationship of a 1:1/2.

In the first embodiment, the pitches of the two electrostatic image graduations formed so as to be partly overlapped are the same. In contrast, in the seventh embodiment, although the configuration or the system of the image forming apparatuses is the same as the first embodiment, the pitches of the two electrostatic image graduations formed so as to be partly overlapped with each other are different. Therefore, in the configurations common to the first embodiment in FIG. 26 and FIG. 27 are designated by reference numerals same as those in FIG. 14, and overlapped description will be omitted.

As illustrated in FIG. 26, in the seventh embodiment, the pitches of the electrostatic image graduations 6*a* and the electrostatic image graduations 6*b* are differentiated to separate the detection signals from the both. As illustrated in FIG. 27, in the seventh embodiment, the electrostatic image graduations 6*a* and the electrostatic image graduations 6*b* are formed so as to be inclined by an angle of ±θ1 from the line 18 in the belt width direction in the same manner as in the first to the sixth embodiments. However, description will be given with reference to FIG. 26 by using the electrostatic image graduations 6*a* and 6*b* parallel to the line 18 in the belt width direction for the sake of convenience.

Figures 26A, 26B, 26C, 26D, 26E:
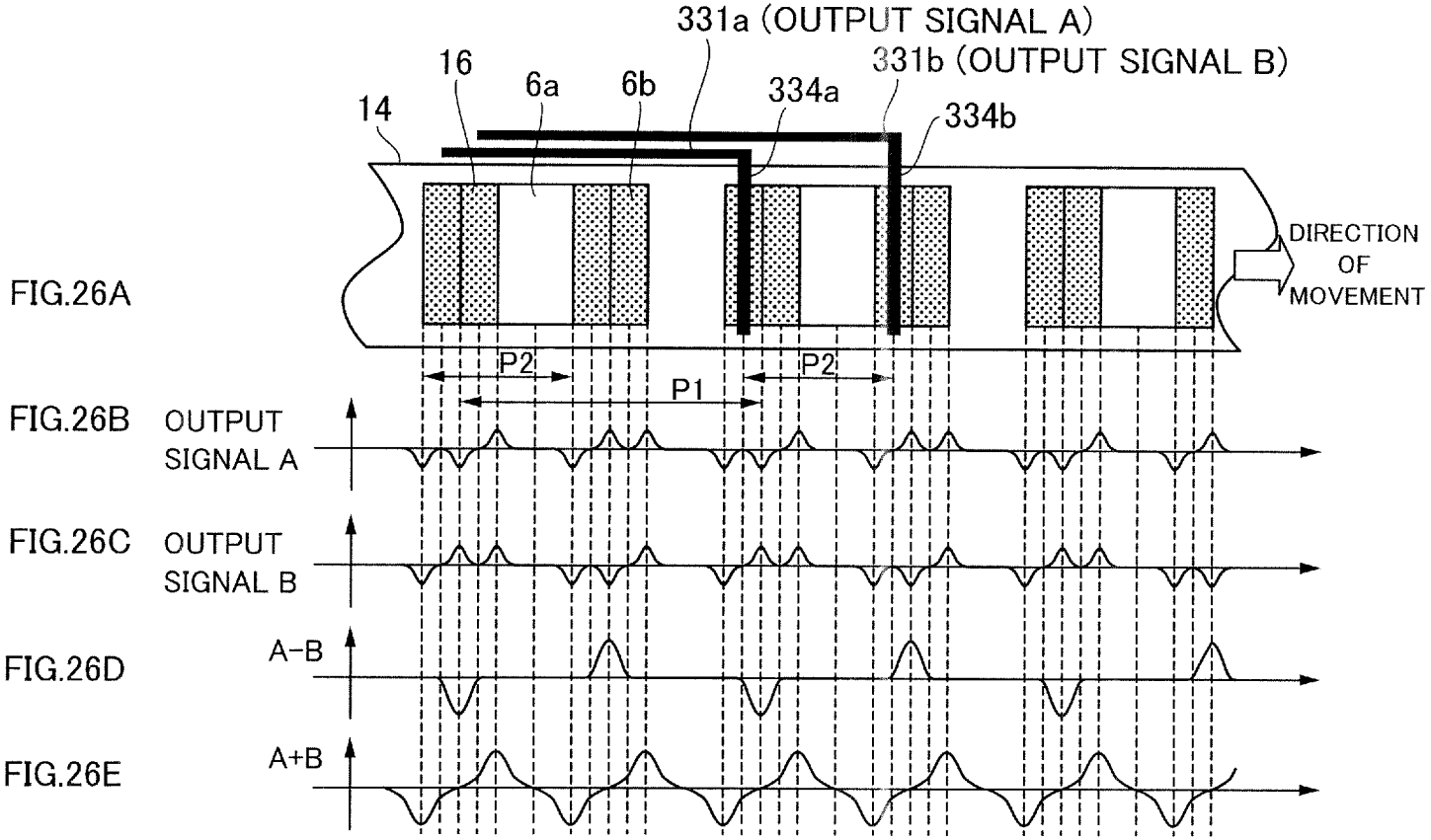
FIG. 26A is a schematic drawing illustrating an electrostatic image graduation and an induced current sensor of a seventh embodiment.
FIG. 26B is a graph illustrating an output signal detected by the detecting portion of a Ch1 conducting wire.
FIG. 26C is a graph illustrating an output signal detected by the detecting portion of a Ch2 conducting wire.
FIG. 26D is a graph illustrating a differential between the output signal detected by the detecting portion of the Ch1 conducting wire and the output signal detected by the detecting portion of the Ch2 conducting wire.
FIG. 26E is a graph illustrating a sum between the output signal detected by the detecting portion of the Ch1 conducting wire and the output signal detected by the detecting portion of the Ch2 conducting wire.
Figure 27:
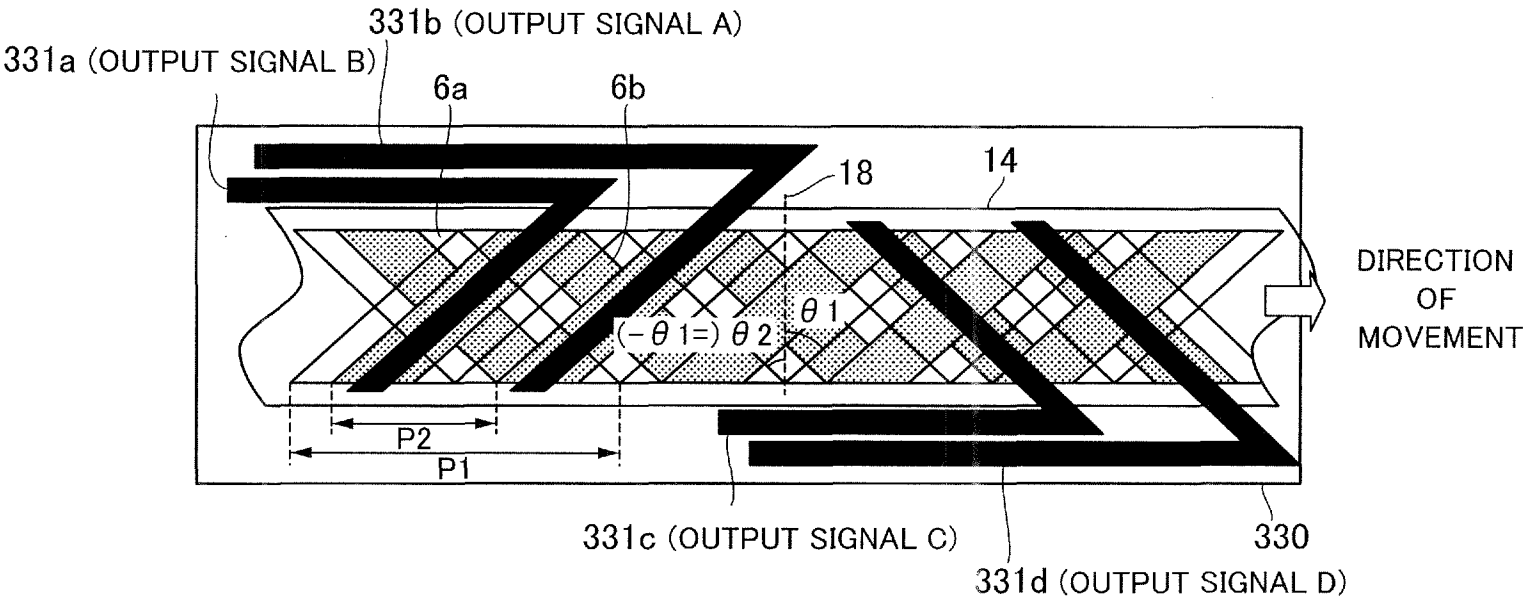
FIG. 27 is an explanatory drawing of an arrangement of the electrostatic image graduation and belt scale detecting sensors of the seventh embodiment.

As illustrated in FIG. 26A, the electrostatic image graduations 6*a* and the electrostatic image graduations 6*b* are parallel to each other, and are arranged so that the longitudinal direction thereof extends perpendicular to the direction of movement of the electrostatic image recording layers 14. A pitch P1 of the electrostatic image graduations 6*a* is double of a pitch P2 of the electrostatic image graduations 6*b*.

The detecting portion 334*a* of the Ch1 conducting wire 331*a* and the detecting portion 334*b* of the Ch2 conducting wire 331*b* are parallel to the electrostatic image graduations 6*a* and 6*b*. The distance between the detecting portion 334*a* of the Ch1 conducting wire 331*a* and the detecting portion 334*b* of the Ch2 conducting wire 331*b* is equal to the pitch P2 of the electrostatic image graduations 6*b*. An output signal from the Ch1 conducting wire 331*a* is defined as A and an output signal from the Ch2 conducting wire 331*b* is defined as B.

As illustrated in FIG. 26B, peaks of the output signal A are detected because the potential change occurs at edge portions of the electrostatic image graduations 6*a* and 6*b*. As illustrated in FIG. 14, the potential of the scale overlapped portion 16 is lower than that of the peripheral portion, peaks are detected at the edge of the scale overlapped portion 16. Furthermore, the peak values as illustrated in FIG. 3 may be controlled by changing the electrostatic image graduation transfer voltage, peak values at the edge of the scale overlapped portion 16 and the peak values of other edges may be aligned. The output signal B is detected with a delay of an amount corresponding to the distance P2 behind the output signal A.

The positions of the electrostatic image graduations 6*a* and 6*b* may be measured from the output signals A and B as described below.

(1) Peaks are detected from a difference between the output signals A and B, that is, A-B, at edge portions of the electrostatic image graduations 6*a* as illustrated in FIG. 26D. Therefore, the position of the electrostatic image graduations 6*a* may be detected from the difference between the output signals A and B.

(2) Peaks are detected from a sum of the output signals A and B, that is, A+B, at edge portions of the electrostatic image graduations 6*b* as illustrated in FIG. 26E. Therefore, the position of the electrostatic image graduations 6*b* may be detected from the sum of the output signals A and B.

The electrostatic image graduations 6*a* and 6*b* using such a principle are formed so as to incline from the line 18 in the belt width direction by the angle of ±θ1 as in the first embodiment, so that the four types of signals may be separated by using the belt scale reading sensors having detecting portions inclined from the line 18 in the belt width direction by the angle of ±θ1.

As illustrated in FIG. 27, the electrostatic image graduations 6*a* and 6*b* are formed of two parallelograms and the longitudinal directions thereof intersect respectively at the angles of θ1 and θ2 with the line 18 in the belt width direction, and the end portions of the longitudinal directions match the direction of conveyance of the electrostatic image recording layers 14. When the distance (pitch) of the two parallel patterns of electrostatic image graduations 6*a* are defined as P1, and the distance (pitch) of the two parallel patterns of the electrostatic image graduations 6*b* are defined as P2, P1=2× P2.

As illustrated in FIG. 27, the Ch1 conducting wire 331*a* and the Ch2 conducting wire 331*b* are inclined by the angle of θ1 with respect to the line 18 in the belt width direction, and the distance is P2. The Ch1 conducting wire 331*a* and the Ch2 conducting wire 331*b* need to be prevented from reading of the electrostatic image graduations inclined by the angle of θ2 with respect to the line in the belt width direction.

The Ch3 conducting wire 331*c* and the Ch4 conducting wire 331*d* are inclined by the angle of θ2 with respect to the line 18 in the belt width direction, and the distance is P2. The Ch3 conducting wire 331*c* and the Ch4 conducting wire 331*d* need to be prevented from reading of the electrostatic image graduations inclined by the angle of θ1 with respect to the line in the belt width direction. The condition therefor is that the electrostatic image graduations 6*a* and the electrostatic image graduations 6*b* satisfy the equation (13).

When A is the output signal from the Ch1 conducting wire 331*a*, B is the output signal from the Ch2 conducting wire 331*b*, C is the output signal from the Ch3 conducting wire 331*c*, and D is an output signal from the Ch4 conducting wire 331*d*, the electrostatic image graduations may be obtained by an arithmetic calculation of Table 3 given below.

TABLE 3

| SEPARATION AND ARITHMETIC CALCULATION OF SIGNALS | |
|---|---|
| ARITHMETIC EQUATION | DETECTED ELECTROSTATIC IMAGE GRADUATION |
| A − B | FIRST ELECTROSTATIC IMAGE GRADUATIONS INCLINED BY θ1 |
| A + B | SECOND ELECTROSTATIC IMAGE GRADUATIONS INCLINED BY θ1 |
| C − D | FIRST ELECTROSTATIC IMAGE GRADUATIONS INCLINED BY θ2 |
| C + D | SECOND ELECTROSTATIC IMAGE GRADUATIONS INCLINED BY θ2 |

The timing of detection of the electrostatic image graduations to be detected by A−B is defined as t1, the timing of detection of the electrostatic image graduations to be detected by A+B is defined as T2, the timing of detection of the electrostatic image graduations detected by C−D is defined as t3, and the timing of detection of the electrostatic image graduations to be detected by C+D is defined as t4. At this time, breaking down of the color shift is enabled by an arithmetic calculation shown in Table 1.

Eighth Embodiment

Part or an entire part of the configuration of this disclosure may be implemented by another embodiment in which the configurations are replaced by alternative configurations as long as the electrostatic image graduations inclined from the line extending in the main scanning direction are detected by using the induced current sensor inclined by the same angle from the line extending in the main scanning direction.

Therefore, as long as the image forming apparatus configured to superimpose a plurality of toner images, the configuration of this disclosure may be implemented irrespective of whether it is a one-drum type or a tandem type, or whether it is an intermediate transfer system or recording material conveying member system. The configuration of this disclosure may be implemented irrespective of the number of the image bearing members, the charging system of the image bearing member, the method of forming the electrostatic images, the developer and the developing system, or the transfer system.

Control of superimposing the toner images includes not only the setting of the exposure start timing performed when the image is not formed, but also a real-time adjustment during the image formation. In the embodiments, only the principal portions relating to formation and transfer of the toner images are described. However, this disclosure may be implemented in image forming apparatuses for various applications such as printers, various types of printing machines, copying machines, facsimile machines, and multiple function processing machines by adding required instruments, equipment, housing structures and the like.

<Other Embodiments>

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment (s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-029573, filed Feb. 19, 2013 which is hereby incorporated by reference herein in its entirety.

What is claimed is:

1. An image forming apparatus comprising:

a first photosensitive member configured to have a toner image formed on a surface thereof;

a first exposure device configured to form an electrostatic image which becomes the toner image by being developed on the first photosensitive member and to form a first electrostatic image index formed by a linear electrostatic image that is inclined by a first angle in a main scanning direction orthogonal to a sub scanning direction, which corresponds to the direction of rotation of the first photosensitive member, on the first photosensitive member;

a conveying member;

a first transfer portion configured to transfer the first electrostatic image index formed on the first photosensitive member to the conveying member together with the toner image;

a second photosensitive member disposed downstream of the first photosensitive member in a direction of movement of the conveying member;

a second exposure device configured to form a linear second electrostatic image index that is inclined by a second angle different from the first angle in the main scanning direction of the second photosensitive member on the second photosensitive member;

a second transfer portion configured to transfer the second electrostatic image index formed on the second photosensitive member so as to overlap with the first electrostatic image index that is transferred to the conveying member;

a first detecting portion having a linear conductive member inclined by the first angle in the main scanning direction with respect to the conveying member and configured to detect an induced current generated in the linear conductive member inclined by the first angle by passage of the first electrostatic image index transferred to the conveying member; and a second detecting portion having a linear conductive member inclined by the second angle in the main scanning direction with respect to the conveying member and configured to detect an induced current generated in the linear conductive member inclined by the second angle by passage of the second electrostatic image index transferred to the conveying member.

2. The image forming apparatus according to claim 1, wherein the first exposure device forms a linear third electrostatic image index inclined by a third angle in a direction opposite to the first angle in the main scanning direction of the first photosensitive member on the first photosensitive member in association with the formation of the first electrostatic image index, and wherein the second exposure device forms a linear fourth electrostatic image index inclined by a fourth angle in a direction opposite to the second angle in the main scanning direction of the second photosensitive member on the second photosensitive member in association with the formation of the second electrostatic image index, the image forming apparatus further comprising: a third detecting portion having a linear conductive member inclined by the third angle in the main scanning direction with respect to the conveying member and configured to detect an induced current generated in the linear conductive member inclined by the third angle by passage of the third electrostatic image index transferred to the conveying member; and a fourth detecting portion having a linear conductive member inclined by the fourth angle in the main scanning direction with respect to the conveying member and configured to detect an induced current generated in the linear conductive member inclined by the fourth angle by passage of the fourth electrostatic image index transferred to the conveying member.

3. The image forming apparatus according to claim 1, wherein the first detecting portion and the second detecting portion are arranged downstream of the second photosensitive member in the direction of movement of the conveying member, the image forming apparatus further comprising a control portion having a detection mode in which the first electrostatic image index and the second electrostatic image index are formed and transferred to the conveying member and are detected by the first detecting portion and the second detecting portion at the time of non-image formation, and configured to adjust the position of formation of the toner image in the sub scanning direction on at least one of the first photosensitive member and the second photosensitive member on the basis of the result of detection in the detection mode.

4. The image forming apparatus according to claim 2, wherein the third detecting portion and the fourth detecting portion are arranged downstream of the second photosensitive member in the direction of movement of the conveying member, the image forming apparatus further comprising a control portion having a detection mode in which the first electrostatic image index, the second electrostatic image index, the third electrostatic image index, and the fourth electrostatic image index are formed and transferred to the conveying member and are detected by the first detecting portion, the second detecting portion, the third detecting portion, and the fourth detecting portion at the time of non-image formation, and configured to adjust the position of formation of the toner image in the main scanning direction and the sub scanning direction on at least one of the first photosensitive member and the second photosensitive member on the basis of the result of detection in the detection mode.

5. The image forming apparatus according to claim 2, wherein the first electrostatic image index, the second electrostatic image index, the third electrostatic image index, and the fourth electrostatic image index are transferred to one end portion and the other end portion of the conveying member in the main scanning direction, respectively, and wherein the first detecting portion, the second detecting portion, the third detecting portion, and the fourth detecting portion are arranged so as to oppose to one end portion and the other end portion of the conveying member in the main scanning direction, respectively, the image forming apparatus further comprising a control portion configured to adjust at least one of a magnification shift in the main scanning direction and the inclination of the main scanning direction of the toner image on at least one of the first photosensitive member and the second photosensitive member on the basis of the result of detection of the first electrostatic image index, the second electrostatic image index, the third electrostatic image index, and the fourth electrostatic image index on the one end portion and the other end portion of the conveying member in the main scanning direction.

6. The image forming apparatus according to claim 2, wherein the first electrostatic image index, the second electrostatic image index, the third electrostatic image index, and the fourth electrostatic image index are transferred in an overlapped manner on the conveying member with different angles of inclination with respect to the main scanning direction, respectively.

7. The image forming apparatus according to claim 4, wherein the first electrostatic image index, the second electrostatic image index, the third electrostatic image index, and the fourth electrostatic image index are transferred in an overlapped manner on the conveying member with different angles of inclination with respect to the main scanning direction, respectively.

8. The image forming apparatus according to claim 5, wherein the first electrostatic image index, the second electrostatic image index, the third electrostatic image index, and the fourth electrostatic image index are transferred in an overlapped manner on the conveying member with different angles of inclination with respect to the main scanning direction, respectively.

9. The image forming apparatus according to claim 2, wherein the first electrostatic image index, the second electrostatic image index, the third electrostatic image index, and the fourth electrostatic image index are transferred in an overlapped manner on the conveying member, and two of the first electrostatic image index, the second electrostatic image index, the third electrostatic image index, and the fourth electrostatic image index have the same angle of inclination with respect to the main scanning direction and have pitches of 1:1/2.

10. The image forming apparatus according to claim 4, wherein the first electrostatic image index, the second electrostatic image index, the third electrostatic image index, and the fourth electrostatic image index are transferred in an overlapped manner on the conveying member, and two of the first electrostatic image index, the second electrostatic image index, the third electrostatic image index, and the fourth electrostatic image index have the same angle of inclination with respect to the main scanning direction and have pitches of 1:1/2.

11. The image forming apparatus according to claim 5, wherein the first electrostatic image index, the second electrostatic image index, the third electrostatic image index, and the fourth electrostatic image index are transferred in an overlapped manner on the conveying member, and two of the first electrostatic image index, the second electrostatic image index, the third electrostatic image index, and the fourth electrostatic image index have the same angle of inclination with respect to the main scanning direction and have pitches of 1:1/2.

12. The image forming apparatus according to claim 1, wherein a plurality of second photosensitive members are arranged in the direction of movement of the conveying member, and wherein the second electrostatic image index is transferred individually from each of the second photosensitive members to different positions on a row of the first electrostatic image index that has been transferred from the first photosensitive member to the conveying member in the sub scanning direction.

13. The image forming apparatus according to claim 1, wherein the conductive member of the first detecting portion and the conductive member of the second detecting portion are independent wiring patterns on a common sheet arranged so as to slide on the conveying member.

14. The image forming apparatus according to claim 6, wherein the conductive member of the first detecting portion and the conductive member of the second detecting portion are independent wiring patterns on a common sheet arranged so as to slide on the conveying member.

15. The image forming apparatus according to claim 13, wherein the conductive member of the first detecting portion and the conductive member of the second detecting portion are arranged so as to intersect each other on the common sheet.

16. The image forming apparatus according to claim 14, wherein the conductive member of the first detecting portion and the conductive member of the second detecting portion are arranged so as to intersect each other on the common sheet.

17. The image forming apparatus according to claim 1, wherein the first electrostatic image index and the second electrostatic image index are formed as a parallelogram having two sides parallel to the direction of movement of the conveying member, and wherein the first electrostatic image index and the second electrostatic image index satisfy a relationship of an equation $$nP/2=W\times\tan\theta \text{ (}n\text{ is an integer)},$$

where $\pm\theta$ are angles of inclination with respect to the main scanning direction, W is a length, and P is a pitch.

* * * * *